US010101690B2

(12) United States Patent
Sugiura et al.

(10) Patent No.: US 10,101,690 B2
(45) Date of Patent: Oct. 16, 2018

(54) IMAGE FORMING APPARATUS

(71) Applicants: Kenji Sugiura, Kanagawa (JP); Naohiro Kumagai, Kanagawa (JP); Seiichi Kogure, Kanagawa (JP); Junpei Fujita, Kanagawa (JP); Kazuki Yogosawa, Kanagawa (JP); Yuuji Wada, Kanagawa (JP); Jyunya Sakuraba, Kanagawa (JP)

(72) Inventors: Kenji Sugiura, Kanagawa (JP); Naohiro Kumagai, Kanagawa (JP); Seiichi Kogure, Kanagawa (JP); Junpei Fujita, Kanagawa (JP); Kazuki Yogosawa, Kanagawa (JP); Yuuji Wada, Kanagawa (JP); Jyunya Sakuraba, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/596,365

(22) Filed: May 16, 2017

(65) Prior Publication Data

US 2017/0329263 A1 Nov. 16, 2017

(30) Foreign Application Priority Data

May 16, 2016 (JP) ..... 2016-098007

(51) Int. Cl.
*G03G 15/16* (2006.01)

(52) U.S. Cl.
CPC ..... *G03G 15/1665* (2013.01)

(58) Field of Classification Search
CPC ..... G03G 15/163; G03G 15/1635; G03G 15/1665; G03G 15/1675
See application file for complete search history.

(56) References Cited

U.S. PATENT DOCUMENTS 5,034,777 A * 7/1991 Ohzeki ..... G03G 15/1675 399/176
7,555,236 B2 * 6/2009 Saeki ..... G03G 15/168 399/101

(Continued)

FOREIGN PATENT DOCUMENTS

JP 2002072713 A * 3/2002
JP 2007171600 A * 7/2007

(Continued)

*Primary Examiner* — David Bolduc
(74) *Attorney, Agent, or Firm* — Oblon, McClelland, Maier & Neustadt, L.L.P.

(57) ABSTRACT

An image forming apparatus includes an image bearer including a first image portion to bear a first toner image, a second image portion to bear a second toner image, and a non-image portion to bear an adjustment pattern. A transferor forms a transfer nip with the image bearer. A controller controls the power source to output an image bias as a transfer bias to transfer the first toner image and the second toner image onto a first recording medium and a second recording medium, respectively, in the transfer nip when the first image portion and the second image portion pass through the transfer nip and output a non-image bias as the transfer bias when the non-image portion passes through the transfer nip. The controller performs a constant current control on the image bias and performs a constant voltage control when the image bias switches to the non-image bias.

17 Claims, 17 Drawing Sheets

(56) References Cited

U.S. PATENT DOCUMENTS 8,805,247 B2 * 8/2014 Takahashi ..... G03G 15/161 399/101
8,934,803 B2 * 1/2015 Okubo ..... G03G 15/80 399/66
2004/0062560 A1 * 4/2004 Mochizuki ..... G03G 15/1635 399/49
2006/0127124 A1 * 6/2006 Ota ..... G03G 15/161 399/101
2008/0260401 A1 * 10/2008 Shimazaki ..... G03G 15/1675 399/66
2009/0067864 A1 * 3/2009 Shirafuji ..... G03G 15/161 399/66
2010/0322652 A1 * 12/2010 Torimaru ..... G03G 15/0131 399/66
2011/0229187 A1 9/2011 Hozumi et al.
2012/0008991 A1 * 1/2012 Shimizu ..... G03G 15/1675 399/297
2012/0027442 A1 * 2/2012 Torimaru ..... G03G 15/161 399/44
2012/0045237 A1 2/2012 Aoki et al.
2012/0224870 A1 9/2012 Kikuchi et al.
2012/0308249 A1 * 12/2012 Matsumoto ..... G03G 15/161 399/66
2012/0308250 A1 12/2012 Shimizu et al.
2012/0315058 A1 12/2012 Shimizu et al.
2012/0328315 A1 12/2012 Takeuchi et al.
2013/0077984 A1 * 3/2013 Yoshida ..... G03G 15/1605 399/66
2013/0089347 A1 * 4/2013 Murata ..... G03G 15/1605 399/66
2013/0156455 A1 * 6/2013 Kakehi ..... G03G 15/18 399/66
2013/0164011 A1 * 6/2013 Nakamura ..... G03G 15/1675 399/66
2014/0328603 A1 11/2014 Mizutani et al.
2014/0328604 A1 11/2014 Tanaka et al.
2015/0016833 A1 * 1/2015 Nakaegawa ..... G03G 15/0189 399/66
2015/0023679 A1 * 1/2015 Nakaegawa ..... G03G 15/1605 399/66
2015/0037054 A1 2/2015 Nagata et al.
2015/0346652 A1 * 12/2015 Ohmura ..... G03G 15/1675 399/66
2016/0033915 A1 2/2016 Kumagai et al.
2016/0041508 A1 2/2016 Kogure et al.
2016/0109832 A1 4/2016 Ohsugi et al.
2016/0161887 A1 6/2016 Sugiura et al.
2016/0161888 A1 6/2016 Wada et al.
2016/0274503 A1 9/2016 Sugiura et al.
2016/0274504 A1 9/2016 Wada et al.
2016/0274505 A1 9/2016 Ohsugi et al.
2016/0334738 A1 11/2016 Kochi et al.

FOREIGN PATENT DOCUMENTS

JP 2012-042835 3/2012
JP 2014-123004 7/2014
JP 2014153376 A * 8/2014
JP 2014-232127 12/2014
JP 2016-080826 5/2016

* cited by examiner

FIG. 8D
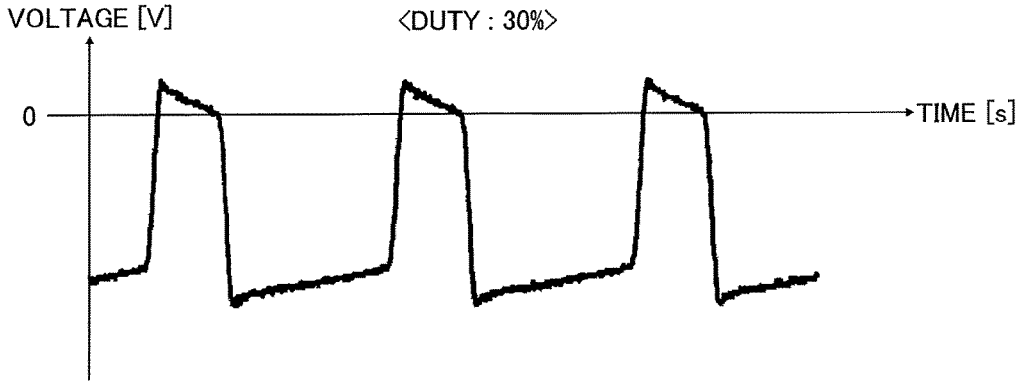
FIG. 8E
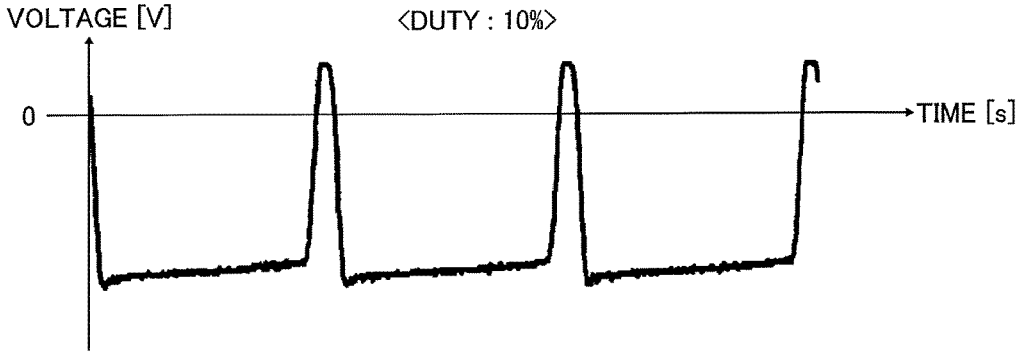
FIG. 8F
| Duty[%] | 90 | 70 | 50 | 30 | 10 |
|---|---|---|---|---|---|
| GRADE | 5 | 5 | 3 | 1 | 1 |

IMAGE FORMING APPARATUS

CROSS-REFERENCE TO RELATED APPLICATION

This patent application is based on and claims priority pursuant to 35 U.S.C. § 119 to Japanese Patent Application No. 2016-098007, filed on May 16, 2016, in the Japanese Patent Office, the entire disclosure of which is hereby incorporated by reference herein.

BACKGROUND

Technical Field

Exemplary embodiments generally relate to an image forming apparatus, and more particularly, to an image forming apparatus for forming an image on a recording medium.

Background Art

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a developing device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such image forming apparatuses perform an adjustment control such as a process control to adjust an image density and a gradation of the toner image and a color shift correction control to correct shifting of yellow, magenta, cyan, and black toner images superimposed on the intermediate transfer belt to form a color toner image. Under the process control, an adjustment pattern as a test pattern formed on the photoconductor is transferred onto the intermediate transfer belt. A sensor detects the adjustment pattern and calculates a toner adhesion amount of toner of the adjustment pattern, which is adhered to the intermediate transfer belt. Under the color shift correction control, an adjustment pattern as a color shift detection toner image formed on the photoconductor is transferred onto the intermediate transfer belt. The sensor detects the adjustment pattern and calculates a color shift amount of the yellow, magenta, cyan, and black toner images to form the color toner image.

If transfer failure of the adjustment pattern occurs under the adjustment control, the adjustment control is not performed properly, degrading the color toner image output on the recording medium.

If the adjustment control is performed during successive printing, transfer of the adjustment pattern onto the intermediate transfer belt and detection of the adjustment pattern are requested to be performed within a shortened time period such that the adjustment pattern is transferred onto an interval portion on the intermediate transfer belt, which is between a first toner image to be transferred onto a preceding recording medium and a second toner image to be transferred onto a subsequent recording medium.

In order to transfer the adjustment pattern precisely within the shortened time period, a transfer bias is requested to switch from an image bias that transfers the first toner image and the second toner image to a non-image bias that transfers the adjustment pattern within the shortened time period.

However, the transfer bias may not switch quickly. For example, if a power source that outputs the transfer bias includes a direct current (DC) power source and an alternating current (AC) power source connected to the DC power source, the DC power source suffers from a degraded response, hindering the transfer bias from switching to a target non-image bias that transfers the adjustment pattern within the shortened time period.

SUMMARY

This specification describes below an improved image forming apparatus. In one exemplary embodiment, the image forming apparatus includes an image bearer rotatable in a rotation direction. The image bearer includes a first image portion to bear a first toner image, a second image portion to bear a second toner image, and a non-image portion, interposed between the first image portion and the second image portion in the rotation direction of the image bearer, to bear an adjustment pattern. A transferor forms a transfer nip with the image bearer. At least one power source outputs a transfer bias. A controller controls the power source to output an image bias as the transfer bias to transfer the first toner image and the second toner image onto a first recording medium and a second recording medium subsequent to the first recording medium, respectively, in the transfer nip when the first image portion and the second image portion pass through the transfer nip. The controller controls the power source to output a non-image bias as the transfer bias when the non-image portion passes through the transfer nip. The non-image bias is different from the image bias. The controller performs a constant current control on the image bias and performs a constant voltage control when the image bias switches to the non-image bias.

This specification further describes an improved image forming apparatus. In one exemplary embodiment, the image forming apparatus includes an image bearer to bear a toner image and an adjustment pattern. A transferor forms a transfer nip with the image bearer. At least one power source outputs a transfer bias. A controller controls the power source to output an image bias as the transfer bias to transfer a first toner image and a second toner image onto a first recording medium and a second recording medium subsequent to the first recording medium, respectively, in the transfer nip. The controller controls the power source to output a non-image bias as the transfer bias to transfer the adjustment pattern onto the transferor in the transfer nip when an interval portion of the image bearer between the first recording medium and the second recording medium passes through the transfer nip during successive printing. The non-image bias is different from the image bias. The controller performs a constant current control on the image bias and performs a constant voltage control when the image bias switches to the non-image bias.

BRIEF DESCRIPTION OF THE DRAWINGS

A more complete appreciation of the embodiments and many of the attendant advantages and features thereof can be readily obtained and understood from the following detailed description with reference to the accompanying drawings, wherein:

FIG. 8D is a graph illustrating a waveform under the conditions illustrated in FIGS. 7A and 7B and a duty of 30%;

FIG. 8E is a graph illustrating a waveform under the conditions illustrated in FIGS. 7A and 7B and a duty of 10%;

FIG. 8F is a lookup table illustrating a grade under each duty depicted in FIGS. 8A to 8E;

Figure 1:
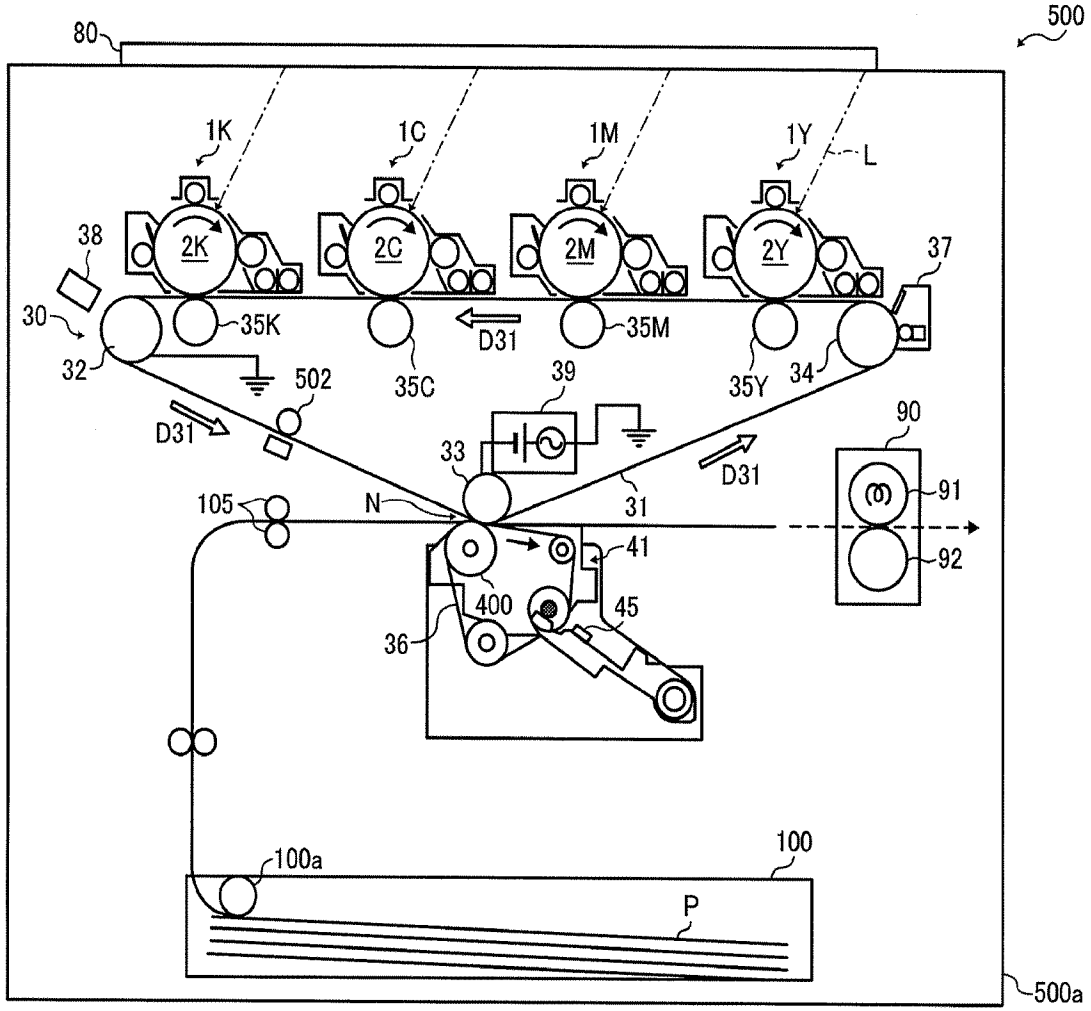
FIG. 1 is a schematic vertical cross-sectional view of an image forming apparatus according to an exemplary embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION OF THE DISCLOSURE

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Referring now to the drawings, wherein like reference numerals designate identical or corresponding parts throughout the several views, particularly to FIG. 1, an image forming apparatus 500 according to an exemplary embodiment is explained.

A description is provided of a construction of the image forming apparatus 500 according to this exemplary embodiment.

FIG. 1 is a schematic vertical cross-sectional view of the image forming apparatus 500.

As illustrated in FIG. 1, the image forming apparatus 500 includes four image forming units 1Y, 1M, 1C, and 1K that form yellow, magenta, cyan, and black toner images, respectively, a transfer unit 30 serving as a transfer device, an optical writing unit 80, a fixing device 90, a paper tray 100, and a registration roller pair 105.

Although the four image forming units 1Y, 1M, 1C, and 1K employ toners in different colors, that is, yellow toner, magenta toner, cyan toner, and black toner as powdery developers, respectively, the four image forming units 1Y, 1M, 1C, and 1K have a similar configuration and are replaced with new ones upon reaching product life cycles of the four image forming units 1Y, 1M, 1C, and 1K. The four image forming units 1Y, 1M, 1C, and 1K are detachably attachable relative to a body 500*a* of the image forming apparatus 500 and replaceable.

Figure 2:
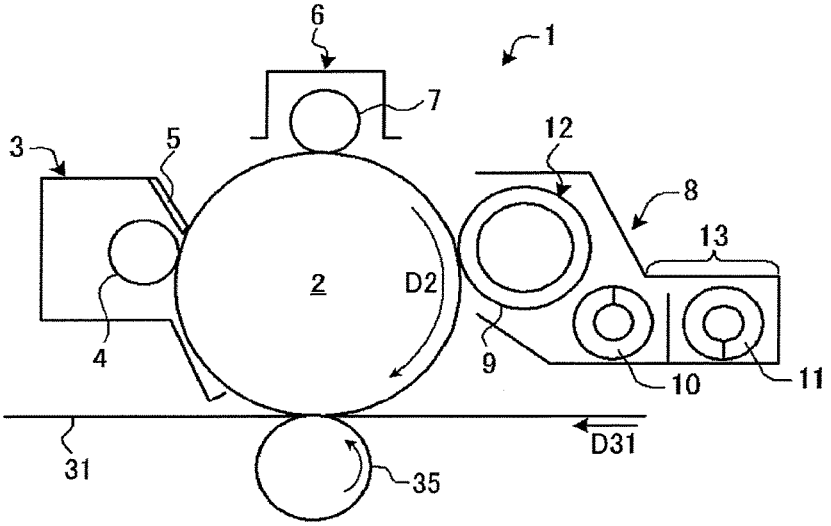
FIG. 2 is an enlarged schematic cross-sectional view of an image forming unit incorporated in the image forming apparatus depicted in FIG. 1.

FIG. 2 is an enlarged schematic cross-sectional view of an image forming unit 1 representing one of the four image forming units 1Y, 1M, 1C, and 1K depicted in FIG. 1. Since the four image forming units 1Y, 1M, 1C, and 1K have the similar configuration except for the color of the toner used therein, FIG. 2 omits suffixes Y, M, C, and K indicating colors, that is, yellow, magenta, cyan, and black, unless otherwise indicated.

The image forming unit 1 includes a drum-shaped photoconductor 2 serving as a latent image bearer or an image bearer, a photoconductor cleaner 3, a discharger, a charging device 6, and a developing device 8. Such devices are held in a common frame so that the devices are detachably installable together relative to the body 500*a* of the image forming apparatus 500, thereby constructing a process cartridge replaceable as a single unit.

The photoconductor 2 is a drum that includes a drum-shaped base and an organic photosensitive layer disposed on a surface of the base. The photoconductor 2 is rotated clockwise in FIG. 2 in a rotation direction D2 by a driver. The charging device 6 includes a charging roller 7, serving as a charger, to which a charging bias is applied. The charging roller 7 contacts or approaches the photoconductor 2 to generate an electrical discharge therebetween, thereby uniformly charging a surface of the photoconductor 2. Instead of using the charging roller 7 or the like that is in contact with or disposed in proximity to the photoconductor 2, a corona charger or the like that does not contact the photoconductor 2 may be employed.

The optical writing unit 80 depicted in FIG. 1 emits exposure light L (e.g., a laser beam) that scans the uniformly charged surface of the photoconductor 2 by the charging roller 7, thereby forming an electrostatic latent image for each color on the surface of the photoconductor 2. The developing device 8 develops the electrostatic latent image on the photoconductor 2 with toner of the respective color. Accordingly, a visible image, that is, a toner image, is formed. The toner image formed on the photoconductor 2 is transferred primarily onto an intermediate transfer belt 31 formed into an endless belt.

The photoconductor cleaner 3 removes residual toner remaining on and adhered to the surface of the photoconductor 2 after a primary transfer process, that is, after the toner image on the photoconductor 2 passes through a primary transfer nip described below. The photoconductor cleaner 3 includes a cleaning brush roller 4 which is rotated and a cleaning blade 5. The cleaning blade 5 is cantilevered, that is, one end thereof is fixed to a housing of the photoconductor cleaner 3, and the other end is a free end that contacts the surface of the photoconductor 2. As the cleaning brush roller 4 rotates, the cleaning brush roller 4 brushes off the residual toner from the surface of the photoconductor 2. The cleaning blade 5 scrapes off the residual toner from the surface of the photoconductor 2, thus cleaning the photoconductor 2.

The discharger removes residual charge remaining on the photoconductor 2 after the photoconductor cleaner 3 cleans the surface of the photoconductor 2. Thus, the surface of the photoconductor 2 is initialized in preparation for a subsequent imaging cycle.

The developing device 8 includes a developing portion 12 and a developer conveyor 13. The developing portion 12 includes a developing roller 9 serving as a developer bearer inside thereof. The developer conveyor 13 stirs and transports a developer. The developer conveyor 13 includes a first chamber equipped with a first screw 10 and a second chamber equipped with a second screw 11. The first screw 10 and the second screw 11 are rotatably supported by, e.g., a casing of the developing device 8. The first screw 10 and the second screw 11 are rotated to convey and deliver the developer to the developing roller 9 while circulating the developer.

As illustrated in FIG. 1, the optical writing unit 80 serving as a latent image writer is disposed above the image forming units 1Y, 1M, 1C, and 1K. Based on image data received from an external device such as a client computer, the optical writing unit 80 illuminates photoconductors 2Y, 2M, 2C, and 2K with exposure light L projected from a light source such as a laser diode of the optical writing unit 80. Accordingly, electrostatic latent images to be developed into yellow, magenta, cyan, and black toner images are formed on the photoconductors 2Y, 2M, 2C, and 2K, respectively.

A description is provided of a construction of the transfer unit 30.

The transfer unit 30 is disposed substantially below the image forming units 1Y, 1M, 1C, and 1K. The transfer unit 30 includes the intermediate transfer belt 31 serving as an image bearer formed into an endless loop and rotated counterclockwise in a rotation direction D31. The transfer unit 30 serves as a belt unit or a transfer device. The transfer unit 30 further includes a plurality of rollers across which the intermediate transfer belt 31 is stretched taut, that is, a drive roller 32, a secondary transfer back surface roller 33, a cleaning auxiliary roller 34, a roller 502, and four primary transfer rollers 35Y, 35M, 35C, and 35K which may be collectively referred to as primary transfer rollers 35. The transfer unit 30 is detachably attachable replaceably relative to the body 500*a* of the image forming apparatus 500. Outside a loop formed by the intermediate transfer belt 31, a secondary transfer unit 41, a belt cleaner 37, and a potential sensor 38 serving as a detector are disposed. The secondary transfer unit 41 includes a secondary transfer belt 36 serving as a secondary transferor or an image bearer.

The intermediate transfer belt 31 is looped around, stretched taut across, and supported by the plurality of rollers disposed inside the loop formed by the intermediate transfer belt 31, i.e., the drive roller 32, the secondary transfer back surface roller 33, the cleaning auxiliary roller 34, the roller 502, and the four primary transfer rollers 35Y, 35M, 35C, and 35K. The drive roller 32 is rotated counterclockwise in FIG. 1 by a driver. Rotation of the drive roller 32 enables the intermediate transfer belt 31 to rotate counterclockwise in FIG. 1 in the rotation direction D31. In the transfer unit 30, the intermediate transfer belt 31 is wound around the plurality of rollers. Accordingly, the plurality of rollers supports and rotates the intermediate transfer belt 31.

The intermediate transfer belt 31 is interposed or sandwiched between the four primary transfer rollers 35Y, 35M, 35C, and 35K and the four photoconductors 2Y, 2M, 2C, and 2K, thereby forming primary transfer nips serving as transfer sections for yellow, magenta, cyan, and black, respectively, where an outer circumferential surface or an image bearing surface of the intermediate transfer belt 31 contacts the photoconductors 2Y, 2M, 2C, and 2K. A transfer bias power source applies a primary transfer bias to each of the primary transfer rollers 35Y, 35M, 35C, and 35K. Accordingly, a transfer electric field is formed between the primary transfer rollers 35Y, 35M, 35C, and 35K and toner images of yellow, magenta, cyan, and black formed on the photoconductors 2Y, 2M, 2C, and 2K, respectively.

A yellow toner image formed on the photoconductor 2Y enters the primary transfer nip for yellow as the photoconductor 2Y rotates. Subsequently, the yellow toner image is primarily transferred from the photoconductor 2Y onto the intermediate transfer belt 31 by the transfer electric field and nip pressure. The intermediate transfer belt 31, on which the yellow toner image has been primarily transferred, passes through the primary transfer nips of magenta, cyan, and black. Subsequently, the toner images of magenta, cyan, and black on the photoconductors 2M, 2C, and 2K are superimposed on the yellow toner image which has been transferred onto the intermediate transfer belt 31, one atop the other, thereby forming a composite toner image on the intermediate transfer belt 31 in the primary transfer process. Accordingly, the composite toner image, in which the toner images of four different colors are superimposed on one atop the other, is formed on the outer circumferential surface of the intermediate transfer belt 31 in the primary transfer process. According to this exemplary embodiment, roller-type primary transferors, that is, the primary transfer rollers 35Y, 35M, 35C, and 35K, are employed as primary transferors. Alternatively, a transfer charger and a brush-type transferor may be employed as the primary transferor.

The secondary transfer unit 41 is disposed outside the loop formed by the intermediate transfer belt 31. A secondary transfer roller 400 of the secondary transfer unit 41 is disposed outside the loop formed by the intermediate transfer belt 31, opposite to the secondary transfer back surface roller 33 disposed inside the loop formed by the intermediate transfer belt 31. The intermediate transfer belt 31 is interposed or sandwiched between the secondary transfer back surface roller 33 and the secondary transfer roller 400, thereby forming a secondary transfer nip N serving as a transfer section at which the outer circumferential surface of the intermediate transfer belt 31 contacts the secondary transfer belt 36. The secondary transfer belt 36 is grounded. By contrast, a secondary transfer bias is applied to the secondary transfer back surface roller 33 by a secondary transfer power source 39. With this configuration, a secondary transfer electrical field is formed between the secondary transfer back surface roller 33 and the secondary transfer belt 36 so that toner having a negative polarity is moved electrostatically from the intermediate transfer belt 31 contacting the secondary transfer back surface roller 33 to a recording medium P contacting the secondary transfer belt 36.

As illustrated in FIG. 1, the paper tray 100 storing a sheaf of recording media P such as paper sheets and resin sheets is disposed in a lower portion of the image forming apparatus 500. The paper tray 100 is equipped with a feed roller 100*a* to contact an uppermost recording medium P of the recording media P in the paper tray 100. As the feed roller 100*a* is rotated at a predetermined speed, the feed roller 100*a* picks up and sends the uppermost recording medium P to a delivery path. Substantially near an end of the delivery path, the registration roller pair 105 is disposed. The registration roller pair 105 temporarily stops rotating, immediately after the recording medium P delivered from the paper tray 100 is interposed between two rollers of the registration roller pair 105. The registration roller pair 105 resumes rotation to feed the recording medium P to the secondary transfer nip N at an appropriate time when the recording medium P is aligned with the composite toner image formed on the intermediate transfer belt 31 at the secondary transfer nip N.

In the transfer unit 30 serving as a belt unit, the intermediate transfer belt 31 is an endless looped belt serving as an image bearer onto which the yellow, magenta, cyan, and black toner images are transferred as the composite toner image. The intermediate transfer belt 31 is looped around and supported by the plurality of rollers, i.e., the drive roller 32, the secondary transfer back surface roller 33, and the cleaning auxiliary roller 34. The composite toner image on the intermediate transfer belt 31 is delivered to the secondary transfer nip N serving as a transfer section at which the composite toner image is transferred from the intermediate transfer belt 31 onto the recording medium P in a secondary transfer process.

At the secondary transfer nip N, the recording medium P tightly contacts the composite toner image on the intermediate transfer belt 31. The yellow, magenta, cyan, and black toner images formed into the composite toner image are secondarily transferred onto the recording medium P collectively by the secondary transfer electric field and the nip pressure applied thereto, thereby forming a full color toner image on a white background on a surface of the recording medium P.

After the intermediate transfer belt 31 passes through the secondary transfer nip N, residual toner failed to be transferred onto the recording medium P remains on the intermediate transfer belt 31. The belt cleaner 37 contacting the outer circumferential surface of the intermediate transfer belt 31 removes the residual toner from the outer circumferential surface of the intermediate transfer belt 31. The cleaning auxiliary roller 34 disposed inside the loop formed by the intermediate transfer belt 31 supports the cleaning operation performed by the belt cleaner 37.

The potential sensor 38 is disposed outside the loop formed by the intermediate transfer belt 31. For example, the potential sensor 38 is disposed opposite a portion of the intermediate transfer belt 31 that is spanned in a circumferential direction of the intermediate transfer belt 31 and wound around the drive roller 32 with a predetermined gap between the potential sensor 38 and the intermediate transfer belt 31. The potential sensor 38 measures a surface potential of the toner image primarily transferred onto the intermediate transfer belt 31 when the toner image comes to a position disposed opposite the potential sensor 38.

On the right of the secondary transfer nip N in FIG. 1 is the fixing device 90. After the secondary transfer process, the recording medium P bearing the full color toner image is transported to the fixing device 90. The fixing device 90 includes a fixing roller 91 accommodating a heat source and a pressure roller 92. The fixing roller 91 contacts the pressure roller 92 to form a fixing nip therebetween. While the recording medium P is sandwiched between the fixing roller 91 and the pressure roller 92 at the fixing nip, toner of the full color toner image is softened and fixed on the recording medium P under heat and pressure. After the full color toner image is fixed to the recording medium P, the recording medium P is output from the fixing device 90. Subsequently, the recording medium P is delivered outside the image forming apparatus 500 via a post-fixing path.

If the image forming apparatus 500 receives a print job to form a monochrome toner image on a recording medium P, a movable support plate supporting the primary transfer rollers 35Y, 35M, and 35C of the transfer unit 30 moves to separate the primary transfer rollers 35Y, 35M, and 35C from the photoconductors 2Y, 2M, and 2C. Accordingly, the outer circumferential surface of the intermediate transfer belt 31, that is, the image bearing surface, is separated from the photoconductors 2Y, 2M, and 2C so that the intermediate transfer belt 31 contacts the photoconductor 2K. In this state, the image forming unit 1K is driven to form a black toner image on the photoconductor 2K.

Alternatively, instead of the secondary transfer belt 36, a secondary transfer roller may be employed as a transferor that forms the secondary transfer nip N between the intermediate transfer belt 31 and the secondary transfer roller. Instead of the secondary transfer back surface roller 33 disposed inside the loop formed by the intermediate transfer belt 31, the transferor disposed outside the loop formed by the intermediate transfer belt 31 (e.g., the secondary transfer roller 400) may apply the secondary transfer bias. The present disclosure may be applied to a color image forming apparatus for forming a color toner image or a monochrome image forming apparatus for forming a monochrome toner image.

Figure 3A:
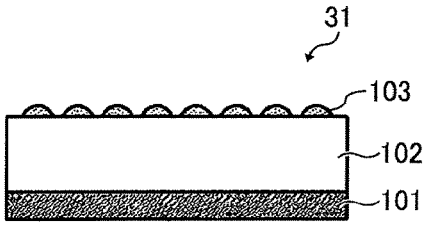
FIG. 3A is a cross-sectional view of an intermediate transfer belt incorporated in the image forming apparatus depicted in FIG. 1.

FIG. 3A is a cross-sectional view of the intermediate transfer belt 31, illustrating layers of the intermediate transfer belt 31. The following describes a construction of the intermediate transfer belt 31 suitable for the image forming apparatus 500. Alternatively, the intermediate transfer belt 31 may have other construction.

As illustrated in FIG. 3A, the intermediate transfer belt 31 includes a base layer 101 having a rigidity that allows bending; an elastic layer 102 that is flexible and layered on the base layer 101; and a plurality of particles 103 layered on the elastic layer 102. The particles 103 are arranged or embedded in an outer face of the elastic layer 102 separately from each other in a surface direction of the elastic layer 102. Thus, the particles 103 form projections and recesses uniformly on the outer face of the elastic layer 102.

A detailed description is now given of a configuration of the base layer 101.

Examples of materials for the base layer 101 include, but are not limited to, a resin in which an electrical resistance adjusting material made of a filler or an additive is dispersed to adjust electrical resistance. Examples of the resin constituting the base layer 101 include, but are not limited to, fluorine-based resins such as ethylene tetrafluoroethylene copolymers (ETFE) and polyvinylidene fluoride (PVDF), polyimide resins, or polyamide-imide resins in terms of flame retardancy. In terms of mechanical strength (e.g., high elasticity) and heat resistance, specifically, polyimide resins or polyamide-imide resins are used.

Examples of the electrical resistance adjusting materials dispersed in the resin include, but are not limited to, metal oxides, carbon blacks, ion conductive materials, and conductive polymers.

Examples of metal oxides include, but are not limited to, zinc oxide, tin oxide, titanium oxide, zirconium oxide, aluminum oxide, and silicon oxide. In order to enhance dispersiveness, surface treatment may be applied to metal oxides in advance.

Examples of carbon blacks include, but are not limited to, ketchen black, furnace black, acetylene black, thermal black, and gas black.

Examples of ion conductive materials include, but are not limited to, tetraalkylammonium salt, trialkyl benzyl ammonium salt, alkylsulfonate, alkylbenzene sulfonate, alkylsulfate, glycerol esters of fatty acid, sorbitan fatty acid ester, polyoxyethylene alkylamine, polyoxyethylene aliphatic alcohol ester, alkylbetaine, and lithium perchlorate. Alternatively, these materials may be used in combination. The electrical resistance adjusting materials are not limited to the above-mentioned materials and compounds.

As materials used to manufacture the intermediate transfer belt 31, a coating liquid may contain a resin component. The coating liquid may further contain a dispersion auxiliary agent, a reinforcing material, a lubricating material, a heat conduction material, an antioxidant, and so forth as needed.

An amount of the electrical resistance adjusting materials contained in a seamless belt, i.e., the intermediate transfer belt 31, is preferably in a range of from $1\times10^{8}$ to $1\times10^{13}$ Ω/sq in surface resistivity and in a range of from $1\times10^{6}$ to $1\times10^{12}$ Ω·cm in volume resistivity. In terms of mechanical strength, an amount of the electrical resistance adjusting materials to be added is determined such that a formed film is not fragile and does not crack easily.

For example, the coating liquid, in which a mixture of the resin component (e.g., a polyimide resin precursor and a polyamide-imide resin precursor) and the electrical resistance adjusting material are adjusted properly, is used to manufacture the seamless belt (e.g., the intermediate transfer belt 31) in which an electrical characteristics (e.g., a surface resistivity and a volume resistivity) and the mechanical strength are well balanced.

The content of the electrical resistance adjusting material in the coating liquid when using carbon black is in a range of from 10% through 25% by weight or preferably, in a range of from 15% through 20% by weight relative to a solid content of the coating liquid. The content of the electrical resistance adjusting material in the coating liquid when using metal oxides is in a range of from 1% through 50% by weight or more preferably, in a range of from 10% through 30% by weight relative to the solid content of the coating liquid.

If the content of the electrical resistance adjusting material is less than the above-described respective range, a desired effect is not achieved. If the content of the electrical resistance adjusting material is greater than the above-described respective range, the mechanical strength of the intermediate transfer belt 31, that is, the seamless belt, drops, which is undesirable in actual use.

The thickness of the base layer 101 is not limited to a particular thickness and may be selected as needed. The thickness of the base layer 101 is preferably in a range of from 30 μm to 150 μm, more preferably in a range of from 40 μm to 120 μm, even more preferably, in a range of from 50 μm to 80 μm.

The base layer 101 having a thickness of less than 30 μm cracks and gets torn easily. The base layer 101 having a thickness of greater than 150 μm may crack when the base layer 101 is bent. By contrast, if the thickness of the base layer 101 is in the above-described respective range, the durability is enhanced. In order to increase the stability of rotation of the intermediate transfer belt 31, the thickness of the base layer 101 is even.

An adjustment method to adjust the thickness of the base layer 101 is not limited to a particular method and may be selected as needed. For example, the thickness of the base layer 101 may be measured using a thickness meter of contact type or eddy current type or a scanning electron microscope (SEM) which measures a cross-section of a film.

A detailed description is now given of a configuration of the elastic layer 102 coating the base layer 101.

The elastic layer 102 layered on the base layer 101 includes an elastic body and mounts the particles 103 described below that produce the projections and the recesses on the outer face of the elastic layer 102. For example, the elastic layer 102 is constructed of the elastic body coating the base layer 101 and mounts the particles 103 arranged on the outer face of the elastic layer 102 in the surface direction of the elastic layer 102.

Examples of elastic materials for the elastic body include, but are not limited to, generally-used resins, elastomers, and rubbers. Elastic materials having a flexibility or an elasticity great enough to attain advantages of the present disclosure, such as elastomer materials and rubber materials, are used.

Examples of the elastomer materials include, but are not limited to, thermoplastic elastomers such as polyesters, polyamides, polyethers, polyurethanes, polyolefins, polystyrenes, polyacrylics, polydienes, silicone-modified polycarbonates, and fluorine-containing copolymers.

Examples of thermosetting resins include, but are not limited to, polyurethane resins, silicone-modified epoxy resins, and silicone modified acrylic resins.

Examples of rubber materials include, but are not limited to, isoprene rubbers, styrene rubbers, butadiene rubbers, nitrile rubbers, ethylene-propylene rubbers, butyl rubbers, silicone rubbers, chloroprene rubbers, acrylic rubbers, chlorosulfonated polyethylenes, fluorocarbon rubbers, urethane rubbers, and hydrin rubbers.

A material having desired characteristics may be selected from the above-described materials. In particular, in order to accommodate a recording medium P with an uneven surface such as LEATHAC (product name) paper, soft materials may be selected.

In order to form a particle layer constructed of the particles 103 on the outer face of the elastic layer 102 made of the above-described materials, thermosetting materials are more preferable than thermoplastic materials. The thermosetting materials have an enhanced adhesion property relative to resin particles due to an effect of a functional group contributing to a curing reaction, thereby fixating reliably. Similarly, vulcanized rubbers are also preferable.

In terms of ozone resistance, flexibility, adhesion properties relative to the particles, application of flame retardancy, environmental stability, and so forth, acrylic rubbers are most preferable among elastic materials for forming the elastic layer 102.

A detailed description is now given of a property of acrylic rubbers.

Acrylic rubbers used to produce the elastic layer 102 are not limited to a specific product. Commercially-available acrylic rubbers may be used. An acrylic rubber of carboxyl group crosslinking type is preferable since the acrylic rubber of the carboxyl group crosslinking type among other cross linking types (e.g., an epoxy group, an active chlorine group, and a carboxyl group) provides enhanced rubber physical properties (specifically, the compression set) and enhanced workability. Preferably, the acrylic rubber of carboxyl group crosslinking type may be used.

A cross-linker used for the acrylic rubber of carboxyl group crosslinking type may contain amine compounds. Multivalent amine compounds are preferable. Examples of the amine compounds include, but are not limited to, aliphatic multivalent amine crosslinking agents and aromatic multivalent amine crosslinking agents.

Furthermore, examples of the aliphatic multivalent amine crosslinking agents include, but are not limited to, hexamethylenediamine, hexamethylenediamine carbamate, and N,N'-dicinnamylidene-1,6-hexanediamine.

Examples of the aromatic multivalent amine crosslinking agents include, but are not limited to, 4,4'-methylenedianiline, m-phenylenediamine, 4,4'-diaminodiphenyl ether, 3,4'-diaminodiphenyl ether, 4,4'-(m-phenylenediisopropylidene) dianiline, 4,4'-(p-phenylenediisopropylidene) dianiline, 2,2'-bis [4-(4-aminophenoxy)phenyl] propane, 4,4'-diaminobenzanilide, 4,4'-bis(4-aminophenoxy)biphenyl, m-xylylenediamine, p-xylylenediamine, 1,3,5-benzenetriamine, and 1,3,5-benzenetriaminomethyl.

The amount of the crosslinking agent is, preferably, in a range of from 0.05 to 20 parts by weight, more preferably, in a range of from 0.1 to 5 parts by weight, relative to 100 parts by weight of the acrylic rubber. An insufficient amount of the crosslinking agent causes failure in crosslinking, hence complicating efforts to maintain the shape of crosslinked products. By contrast, too much crosslinking agent causes crosslinked products to be too stiff, hence degrading elasticity as a crosslinking rubber.

A crosslinking promoter may be mixed in the crosslinking agent employed for the elastic layer 102. The type of crosslinking promoter is not limited particularly. However, the crosslinking promoter may be preferably used with the above-described multivalent amine crosslinking agents. Such crosslinking promoters include, but are not limited to, guanidino compounds, imidazole compounds, quaternary onium salts, tertiary phosphine compounds, and weak acid alkali metal salts.

Examples of the guanidino compounds include, but are not limited to, 1,3-diphenylguanidine and 1,3-di-o-tolylguanidine.

Examples of the imidazole compounds include, but are not limited to, 2-methylimidazole and 2-phenylimidazole.

Examples of the quaternary onium salts include, but are not limited to, tetra-n-butylammonium bromide and octadecyltri-n-butylammonium bromide.

Examples of the multivalent tertiary amine compounds include, but are not limited to, triethylenediamine and 1,8-diazabicyclo[5.4.0]undecene-7 (DBU).

Examples of the tertiary phosphines include, but are not limited to, triphenylphosphine and tri (p-tolyl)phosphine.

Examples of the weak acid alkali metal salts include, but are not limited to, phosphates such as sodium and potassium, inorganic weak acid salts such as carbonate, stearic acid salt, and organic weak acid salts such as lauric acid salt.

The amount of the crosslinking promoter is, preferably, in a range of from 0.1 to 20 parts by weight, more preferably, in a range of from 0.3 to 10 parts by weight, relative to 100 parts by weight of the acrylic rubber. Too much crosslinking promoter causes undesirable acceleration of crosslinking during crosslinking, generation of bloom of the crosslinking promoter on a surface of crosslinked products, and hardening of the crosslinked products. By contrast, an insufficient amount of the crosslinking promoter causes significant degradation of the tensile strength of the crosslinked products and a significant elongation change or a significant change in the tensile strength after heat load.

An acrylic rubber composition of the present disclosure is prepared by an appropriate mixing procedure such as roll mixing, Banbury mixing, screw mixing, and solution mixing. The order in which ingredients are mixed is not particularly limited. However, ingredients that are not easily reacted or decomposed when heated are first mixed thoroughly, and thereafter, ingredients that are easily reacted or decomposed when heated, such as a crosslinking agent, are mixed together in a short period of time at a temperature at which the crosslinking agent is neither reacted nor decomposed.

When heated, the acrylic rubber serves as a crosslinked product. The heating temperature is preferably in a range of from 130 degrees centigrade to 220 degrees centigrade, more preferably, in a range of from 140 degrees centigrade to 200 degrees centigrade. The crosslinking time period is preferably in a range of from 30 seconds through 5 hours.

The heating methods are chosen from methods which are used for crosslinking rubber compositions, such as press heating, steam heating, oven heating, and hot-air heating. In order to reliably crosslink an inside of the crosslinked product, post crosslinking may be additionally carried out after crosslinking is carried out once. The post crosslinking time period varies depending on the heating method, the crosslinking temperature, the shape of the crosslinked product, and the like but is carried out preferably for 1 hour through 48 hours. The heating method and the heating temperature for post crosslinking may be appropriately chosen.

Electrical resistance adjusting agents for adjustment of electrical characteristics and flame retardants to achieve flame retardancy may be added to the selected materials. Furthermore, materials such as antioxidants, reinforcing agents, fillers, and crosslinking promoters may be added as needed.

The electrical resistance adjusting agents to adjust the electrical characteristics may be selected from the above-described materials. However, since the carbon blacks and the metal oxides impair flexibility, the amount of use is suppressed. Ion conductive materials and conductive high polymers are also effective. Alternatively, these materials may be used in combination.

For example, various types of perchlorates and ionic liquids in an amount in a range of from 0.01 parts by weight to 3 parts by weight are added based on 100 parts by weight of rubber. With the ion conductive material in an amount of 0.01 parts by weight or less, the resistivity may not be reduced effectively. However, with the ion conductive material in an amount of 3 parts by weight or more, possibility that the conductive material blooms or bleeds to the outer circumferential surface of the intermediate transfer belt 31 may increase. The resistance of the elastic layer 102 is adjusted such that the surface resistivity of the elastic layer 102 is in a range of from $1\times10^{8}$ Ω/sq to $1\times10^{13}$ Ω/sq and the volume resistivity of the elastic layer 102 is in a range of from $1\times10^{6}$ Ω·cm to $1\times10^{12}$ Ω·cm.

In order to obtain high toner transferability relative to an uneven surface of a recording medium P as is desired in image forming apparatuses using electrophotography, flexibility of the elastic layer 102 is adjusted to have a micro rubber hardness of 35 or less under an environmental condition of a temperature of 23 degrees centigrade and a relative humidity of 50% RH.

In measurement of Martens hardness and Vickers hardness, which are a so-called micro-hardness, a shallow area of a measurement target in a bulk direction, that is, the hardness of a limited area near the surface of the intermediate transfer belt 31, is measured. Therefore, deformation capability of the entire intermediate transfer belt 31 is not evaluated.

Consequently, for example, in a case in which a soft material is used for an uppermost layer of the intermediate transfer belt 31 with a relatively low deformation capability as a whole, the micro-hardness decreases. In such a configuration, the intermediate transfer belt 31 with a low deformation capability does not conform to a surface condition of an uneven surface of the recording medium P, thereby impairing the desired transferability relative to the uneven surface of the recording medium P. In view of the above, preferably, the micro-rubber hardness, which allows the evaluation of the deformation capability of the entire intermediate transfer belt 31, is measured to evaluate the hardness of the intermediate transfer belt 31.

The layer thickness of the elastic layer 102 is, preferably, in a range of from 200 μm to 2 mm, more preferably, in a range of from 400 μm to 1000 μm. If the layer thickness of the elastic layer 102 is small, the elastic layer 102 hinders deformation of the intermediate transfer belt 31 in accordance with the roughness (e.g., the surface condition) of the recording medium P and a transfer-pressure reduction effect. Conversely, if the layer thickness of the elastic layer 102 is great, the elastic layer 102 increases the weight and is susceptible to bending, degrading rotation of the intermediate transfer belt 31. The intermediate transfer belt 31 is bent at a bent portion thereof where the intermediate transfer belt 31 is stretched taut across the drive roller 32, the secondary transfer back surface roller 33, and the cleaning auxiliary roller 34. Thus, the intermediate transfer belt 31 is susceptible to cracks. The layer thickness of the elastic layer 102 is measured by observing a cross-section of the elastic layer 102 using the SEM, for example.

A detailed description is now given of a configuration of the particles 103 coating the elastic layer 102.

The particle 103 is a spherical resin particle that has an average particle diameter of 100 μm or less and is insoluble in an organic solvent. The spherical resin particle has a 3% thermal decomposition temperature of 200 degrees centigrade or higher.

The resin material of the particle 103 is not particularly limited, but may include resins as a main ingredient such as acrylic resins, melamine resins, polyamide resins, polyester resins, silicone resins, and fluorocarbon resins.

Alternatively, surface processing with different materials is applied to a surface of the particle made of the above resin materials. The particle 103 made of the above resin materials also includes rubbers. A surface of a spherical mother particle made of rubber may be coated with a hard resin. Alternatively, the particle 103 may be hollow or porous.

Among the resins mentioned above, the silicone resin particles are most preferred because the silicone resin particles provide enhanced slidability, separability relative to toner, and resistance against wear and abrasion. Preferably, the spherical resin particles are prepared through a polymerization process. The more spherical the particle is, the more preferred.

Preferably, the volume average particle diameter of the particle 103 is in a range of from 1.0 μm to 5.0 μm. The particle 103 is a monodisperse particle. The monodisperse particle is not a particle with a single particle diameter. The monodisperse particle is a particle having a sharp particle size distribution.

For example, the distribution width of the particle diameter of the particles 103 is equal to or less than a value [μm] plus-and-minus a value obtained by multiplying an average particle diameter by 0.5. With the particle diameter of the particle 103 that is less than 1.0 μm, enhancement of transfer performance by the particle 103 may not be achieved sufficiently. By contrast, with the particle diameter of the particle 103 that is greater than 5.0 μm, an interval between the particles 103 increases, which results in an increase in the surface roughness of the intermediate transfer belt 31. In this configuration, toner is not transferred properly and the intermediate transfer belt 31 may not be cleaned precisely. Additionally, the particle 103 has a relatively high insulation property. Thus, if the particle diameter of the particle 103 is too large, charging potential remains, rendering accumulation of electrical charges of the particle 103 during successive printing to cause image defect.

Selection of the particle 103 is not particularly limited. Either commercially-available products or laboratory-derived products may be used as the particle 103. The thus-obtained particle 103 as powder is directly applied to the elastic layer 102 and evened out, thereby evenly distributing the particle 103 with ease. Timing at which the particles 103 are applied to a surface of the elastic layer 102 is not particularly limited. The particles 103 may be applied before or after crosslinking of rubber of the elastic layer 102.

Figure 3B:
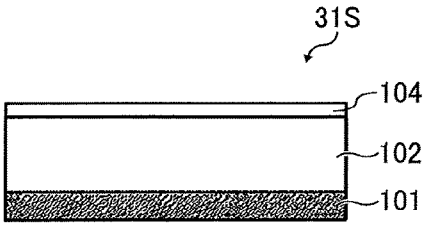
FIG. 3B is a cross-sectional view of a variation of the intermediate transfer belt depicted in FIG. 3A.

FIG. 3B is a cross-sectional view of an intermediate transfer belt 31S incorporating a coating layer 104. As illustrated in FIG. 3B, the coating layer 104 may coat the elastic layer 102.

Figure 4:
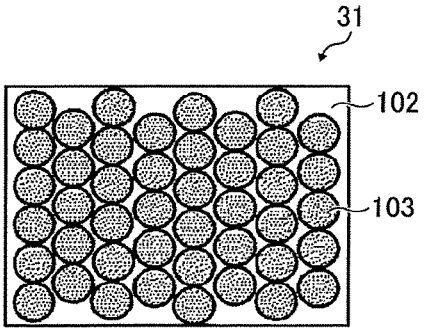
FIG. 4 is a plan view of the intermediate transfer belt depicted in FIG. 3A, illustrating a surface of the intermediate transfer belt seen from a position immediately above the intermediate transfer belt.

FIG. 4 is a plan view of the intermediate transfer belt 31, illustrating a surface of the intermediate transfer belt 31 seen from a position immediately above the intermediate transfer belt 31. As illustrated in FIG. 4, the intermediate transfer belt 31 includes the plurality of particles 103 having a uniform particle diameter and being aligned separately from each other. The particles 103 overlapping each other are barely observed on the surface of the elastic layer 102. The cross-sectional diameters of the plurality of particles 103 on the surface of the elastic layer 102 are uniform. For example, the distribution width of the particle diameter of the particles 103 is preferably equal to or less than the value [μm] plus-and-minus the value obtained by multiplying the average particle diameter by 0.5.

To attain the above distribution width of the particle diameter of the particles 103, a plurality of particles that has the uniform diameter is used. Alternatively, a plurality of particles having a certain particle diameter may be selectively formed on the surface of the elastic layer 102 to attain the above distribution width of the particle diameter of the particles 103.

A projected area rate of a particle exposure portion of the elastic layer 102 that has the particles 103 relative to an elastic layer exposure portion of the elastic layer 102 where the surface of the elastic layer 102 is exposed is equal to or greater than 60% in the surface direction of the elastic layer 102. In a case in which the projected area rate is less than 60%, an exposure area of the elastic layer 102 where the particles 103 do not cover the elastic layer 102 increases. Accordingly, toner contacts the elastic layer 102, degrading transferability of toner, cleanability of the surface of the intermediate transfer belt 31 from which toner is removed, and filming resistance. Alternatively, the intermediate transfer belt 31 may not incorporate the particles 103 that construct the outer circumferential surface of the intermediate transfer belt 31 and therefore may incorporate the base layer 101 and the elastic layer 102.

Figure 5:
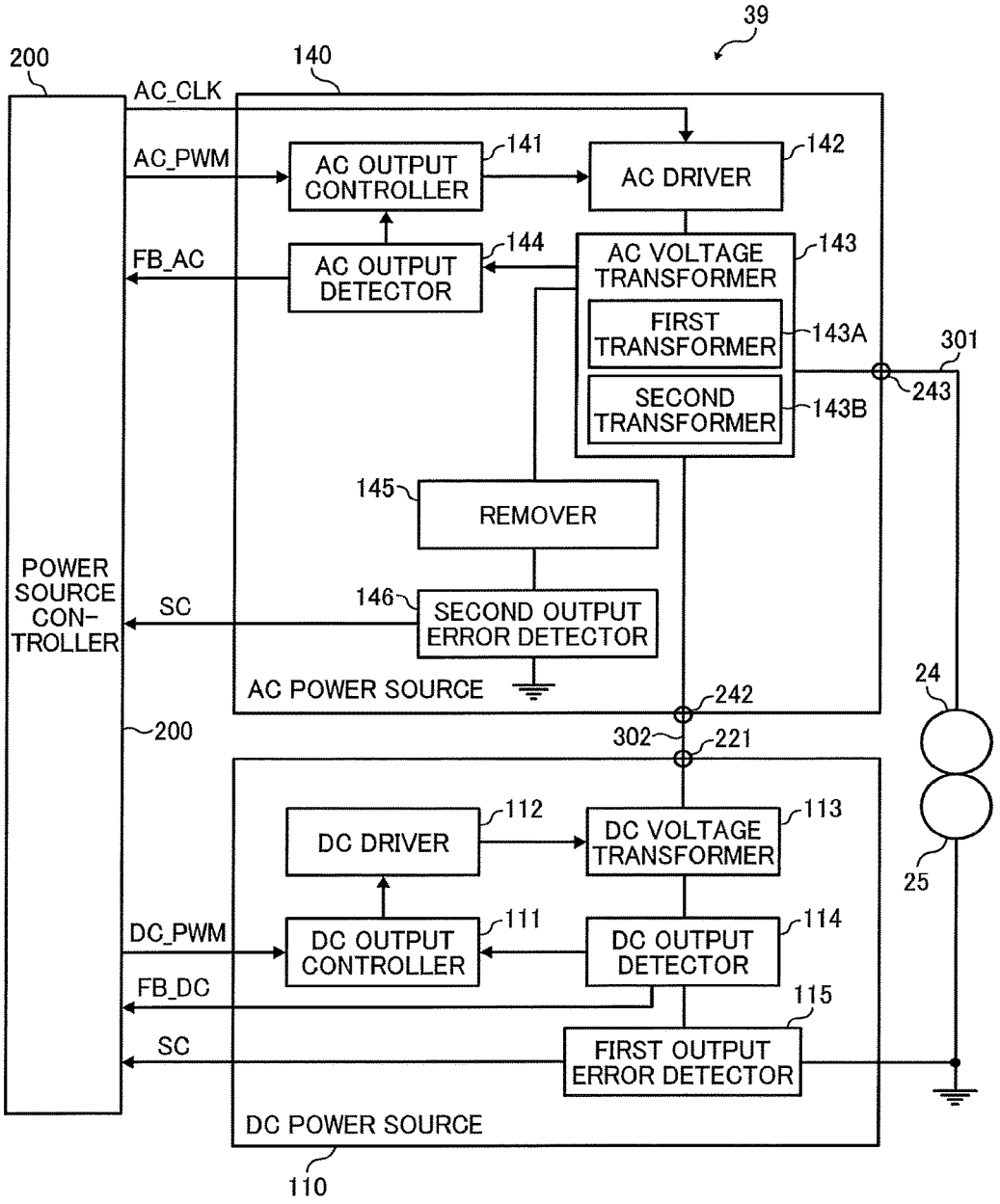
FIG. 5 is a block diagram of a configuration of a secondary transfer power source and a power source controller incorporated in the image forming apparatus depicted in FIG. 1.

FIG. 5 is a block diagram of an example of a configuration of the secondary transfer power source 39 and a power source controller 200. FIG. 5 illustrates one example of the secondary transfer power source 39 incorporating an alternating current (AC) power source 140. As illustrated in FIG. 5, the secondary transfer power source 39 includes a direct current (DC) power source 110, the AC power source 140 that is detachable, and the power source controller 200.

The DC power source 110 is used to transfer the toner image and includes a DC output controller 111, a DC driver 112, a DC voltage transformer 113, a DC output detector 114, a first output error detector 115, and an electrical connector 221 as one example of a first electrical connector.

The AC power source 140 is used to vibrate toner of the toner image and includes an AC output controller 141, an AC driver 142, an AC voltage transformer 143, an AC output detector 144, a remover 145, a second output error detector 146, an electrical connector 242 as one example of a second electrical connector, and an electrical connector 243 as one example of a third electrical connector. According to this exemplary embodiment, the AC voltage transformer 143 includes two transformers, that is, a first transformer 143A and a second transformer 143B.

The power source controller 200 controls the DC power source 110 and the AC power source 140. For example, the power source controller 200 includes a central processing unit (CPU), a read only memory (ROM), and a random access memory (RAM).

The power source controller 200 inputs a DC_PWM signal to the DC output controller 111. The DC_PWM signal controls an output level of a DC voltage. The DC output detector 114 detects an output value of the DC voltage transformer 113 and inputs the output value to the DC output controller 111.

Based on a duty cycle of the input DC_PWM signal and the output value of the DC voltage transformer 113, the DC output controller 111 controls the DC voltage transformer 113 via the DC driver 112 to adjust the output value of the DC voltage transformer 113 to an output value instructed by the DC_PWM signal. The DC driver 112 drives the DC voltage transformer 113 in accordance with an instruction from the DC output controller 111.

The DC driver 112 drives the DC voltage transformer 113 to output a DC high voltage having a negative polarity. In a case in which the AC power source 140 is not connected, the electrical connector 221 and a repulsion roller 24 equivalent to the secondary transfer back surface roller 33 depicted in FIG. 1 are electrically connected by a harness 301 so that the DC voltage transformer 113 outputs or applies a DC voltage to the repulsion roller 24 via the harness 301.

Conversely, in a case in which the AC power source 140 is connected, the electrical connector 221 and the electrical connector 242 are electrically connected by a harness 302 so that the DC voltage transformer 113 outputs a DC voltage to the AC power source 140 via the harness 302.

The DC output detector 114 detects and outputs an output value of the DC high voltage from the DC voltage transformer 113 to the DC output controller 111. The DC output detector 114 outputs the detected output value as an FB_DC signal (e.g., a feedback signal) to the power source controller 200 to control the duty of the DC_PWM signal in the power source controller 200 so as not to impair transferability due to environment and load.

According to this exemplary embodiment, the AC power source 140 is detachably mountable relative to the body 500*a* of the image forming apparatus 500. Thus, an impedance in an output path of the high voltage output is different between when the AC power source 140 is connected and when the AC power source 140 is not connected. Consequently, when the DC power source 110 outputs the DC voltage under constant voltage control, the impedance in the output path changes depending on the presence of the AC power source 140, thereby changing a division rate. Furthermore, the high voltage to be applied to the repulsion roller 24 varies, causing the transferability to vary depending on the presence of the AC power source 140.

In view of the above, according to this exemplary embodiment, the DC power source 110 outputs the DC voltage under constant current control. The output voltage is changed depending on the presence of the AC power source 140. With this configuration, even when the impedance in the output path changes, the high voltage to be applied to the repulsion roller 24 is kept constant, thereby maintaining reliably the transferability irrespective of the presence of the AC power source 140. Furthermore, the AC power source 140 is detached and attached without changing a value of the DC_PWM signal.

According to this exemplary embodiment, the DC power source 110 is under constant current control. Alternatively, the DC power source 110 may be under constant voltage control as long as the high voltage to be applied to the repulsion roller 24 is kept constant by changing the value of the DC_PWM signal upon detachment and attachment of the AC power source 140 or the like.

The first output error detector 115 is disposed on an output line of the DC power source 110. When an output error occurs due to a ground fault or other problems in an electrical system, the first output error detector 115 outputs a service engineer call (SC) signal indicating the output error such as leakage to the power source controller 200. With this configuration, the power source controller 200 controls the DC power source 110 to stop output of the high voltage.

The power source controller 200 inputs an AC_PWM signal to the AC output controller 141. The AC_PWM signal controls an output level of an AC voltage. The AC output detector 144 detects an output value of the AC voltage transformer 143 and inputs the output value to the AC output controller 141.

Based on the duty cycle of the input AC_PWM signal and the output value of the AC voltage transformer 143, the AC output controller 141 controls the AC voltage transformer 143 via the AC driver 142 to adjust the output value of the AC voltage transformer 143 to an output value instructed by the AC_PWM signal.

The power source controller 200 inputs an AC_CLK signal to the AC driver 142. The AC_CLK signal controls the output frequency of the AC voltage. The AC driver 142 drives the AC voltage transformer 143 in accordance with an instruction from the AC output controller 141 and the AC_CLK signal. As the AC driver 142 drives the AC voltage transformer 143 in accordance with the AC_CLK signal, an output waveform generated by the AC voltage transformer 143 is adjusted to an arbitrary frequency instructed by the AC_CLK signal.

The AC driver 142 drives the AC voltage transformer 143 to generate an AC voltage. The AC voltage transformer 143 generates a superimposed voltage in which the generated AC voltage and the DC high voltage output from the DC voltage transformer 113 are superimposed.

In a case in which the AC power source 140 is connected, the electrical connector 243 and the repulsion roller 24 are electrically connected by the harness 301 so that the AC voltage transformer 143 outputs or applies the thus-obtained superimposed voltage to the repulsion roller 24 via the harness 301.

In a case in which the AC voltage transformer 143 does not generate the AC voltage, the AC voltage transformer 143 outputs or applies the DC high voltage output from the DC voltage transformer 113 to the repulsion roller 24 via the harness 301.

Subsequently, the voltage (e.g., the superimposed voltage or the DC voltage) output to the repulsion roller 24 returns to the DC power source 110 via a secondary transfer roller 25 equivalent to the secondary transfer roller 400 depicted in FIG. 1. The AC output detector 144 detects and outputs an output value of the AC voltage from the AC voltage transformer 143 to the AC output controller 141. The AC output detector 144 outputs the detected output value as an FB_AC signal (e.g., a feedback signal) to the power source controller 200 to control the duty of the AC_PWM signal in the power source controller 200 to prevent the transferability from dropping due to environment and load.

According to this exemplary embodiment, the AC power source 140 is under constant voltage control. Alternatively, the AC power source 140 may be under constant current control. Similarly, the DC power source 110 may be under constant voltage control or constant current control. A DC component of the secondary transfer bias may be zero.

The AC voltage generated by the AC voltage transformer 143 of the AC power source 140 may have either a sine wave or a square wave. According to this exemplary embodiment, the AC voltage generated by the AC voltage transformer 143 has a short-pulse square wave. The AC voltage having the short-pulse square wave enhances quality of the toner image formed on the recording medium P.

Figure 6A:
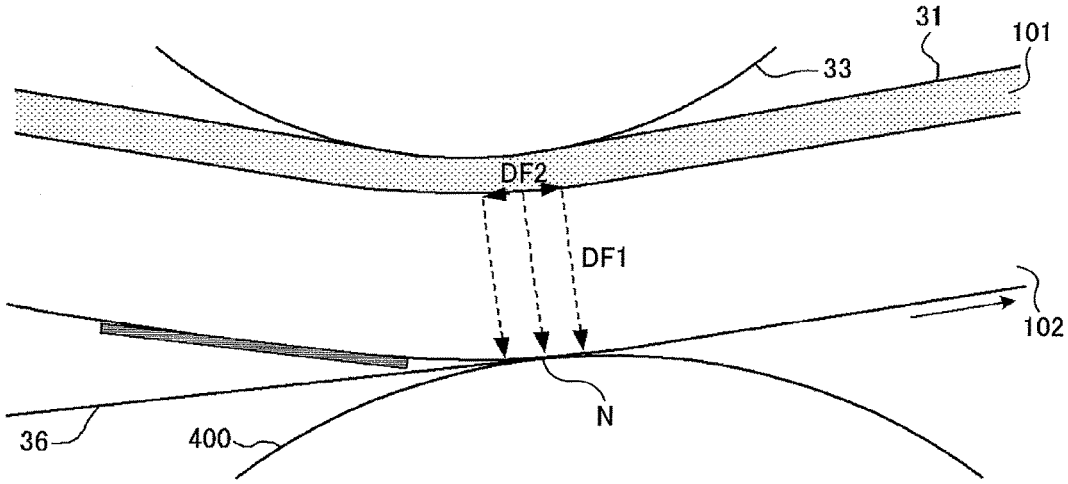
FIG. 6A is a partial cross-sectional view of a secondary transfer back surface roller, the intermediate transfer belt constructed of a plurality of layers, and a secondary transfer roller incorporated in the image forming apparatus depicted in FIG. 1.
Figure 6B:
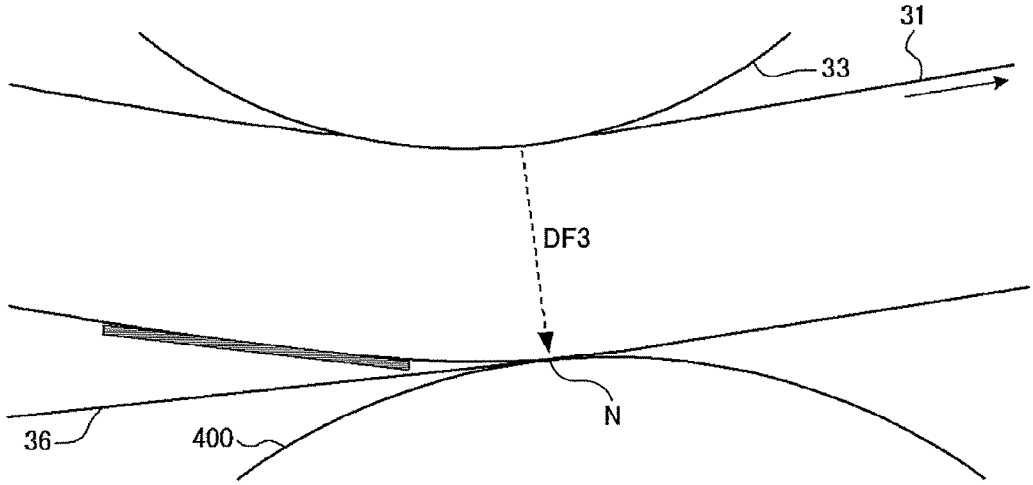
FIG. 6B is a partial cross-sectional view of the secondary transfer back surface roller, the intermediate transfer belt constructed of a single layer, and the secondary transfer roller.

FIG. 6A is a partial cross-sectional view of the secondary transfer back surface roller 33, the intermediate transfer belt 31 constructed of a plurality of layers, and the secondary transfer roller 400, illustrating flow of an electric current at the secondary transfer nip N. FIG. 6B is a partial cross-sectional view of the secondary transfer back surface roller 33, the intermediate transfer belt 31 constructed of a single layer, and the secondary transfer roller 400, illustrating flow of an electric current at the secondary transfer nip N.

As illustrated in FIG. 3A, the intermediate transfer belt 31 includes the base layer 101 and the elastic layer 102 that is flexible and laminated on the base layer 101. When a toner image is secondarily transferred from the intermediate transfer belt 31, constructed of the plurality of layers, that is, the base layer 101 and the elastic layer 102, onto a recording medium P, the secondary transfer back surface roller 33 applies a secondary transfer bias that flows a secondary transfer electric current from the secondary transfer back surface roller 33 to the base layer 101, the elastic layer 102, the toner image, the recording medium P, the secondary transfer belt 36, and the secondary transfer roller 400 in this order in a flow direction DF1 as illustrated in FIG. 6A. Simultaneously, the electric current flows in the circumferential direction of the intermediate transfer belt 31 through an interface between the base layer 101 and the elastic layer 102 horizontally in FIG. 6A in a flow direction DF2. Accordingly, the electric current may flow through the toner image for an extended period of time at the secondary transfer nip N, overcharging the toner image and reversely charging the toner image, which generates transfer failure of the toner image. Alternatively, the intermediate transfer belt 31 may be constructed of three or more layers.

Conversely, as illustrated in FIG. 6B, when a toner image is secondarily transferred from the intermediate transfer belt 31, constructed of the single layer, onto a recording medium P, the secondary transfer back surface roller 33 applies a secondary transfer bias that flows a secondary transfer electric current from the secondary transfer back surface roller 33 to the secondary transfer roller 400 linearly in a flow direction DF3. Accordingly, compared to the intermediate transfer belt 31 constructed of the plurality of layers, the intermediate transfer belt 31 constructed of the single layer causes the electric current to flow through the toner image for a shortened period of time at the secondary transfer nip N, suppressing overcharging of the toner image.

In order to transfer the toner image onto the recording sheet P, a constant amount of voltage is applied to the secondary transfer nip N. However, continuing applying the voltage leads to overcharging of toner, which generates transfer failure, as described above with reference to FIGS. 6A and 6B.

Figure 7A:
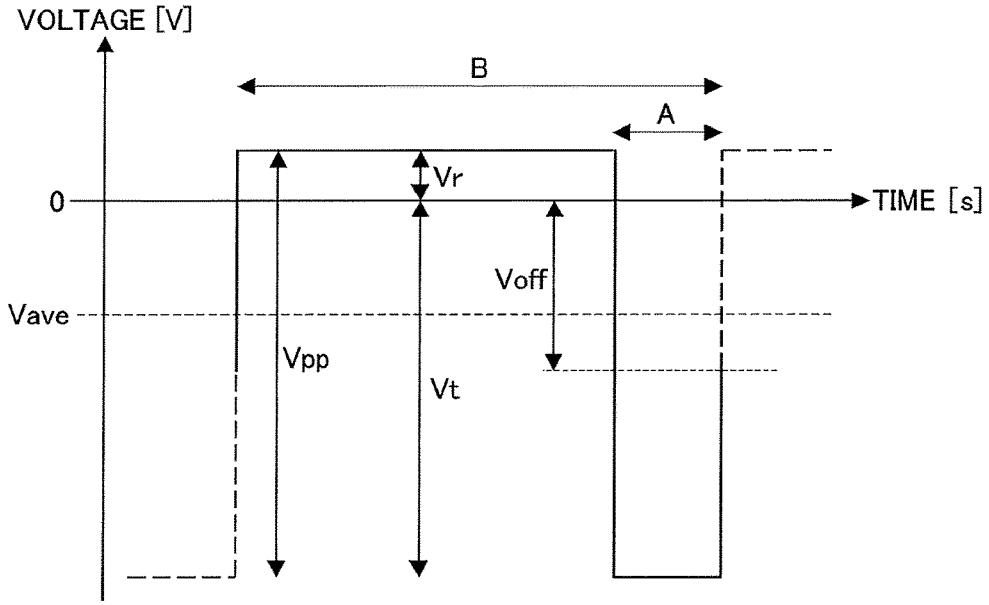
FIG. 7A is a waveform chart of an ideal waveform of a secondary transfer bias applied to the intermediate transfer belt depicted in FIG. 3A.

FIG. 7A is a waveform chart of an ideal waveform of the secondary transfer bias. FIG. 7A illustrates the ideal waveform for transferring a halftone toner image onto a recording medium P properly. In the ideal waveform of FIG. 7A, a requisite amount of voltage with a high duty greater than 50% is applied as the secondary transfer bias, so that a duration of the applied voltage is short and overcharge of toner is prevented. In FIG. 7A, Vr represents a peak value of a positive voltage. Vt represents a peak value of a negative voltage. Voff represents (Vr+Vt)/2. Vpp represents Vr−Vt. Vave represents Vr×Duty/100+Vt×(1−Duty)/100. A represents a duration of Vt. B represents a time period defined by one cycle of a waveform. Duty represents (B−A)/B×100 [%].

Figure 7B:
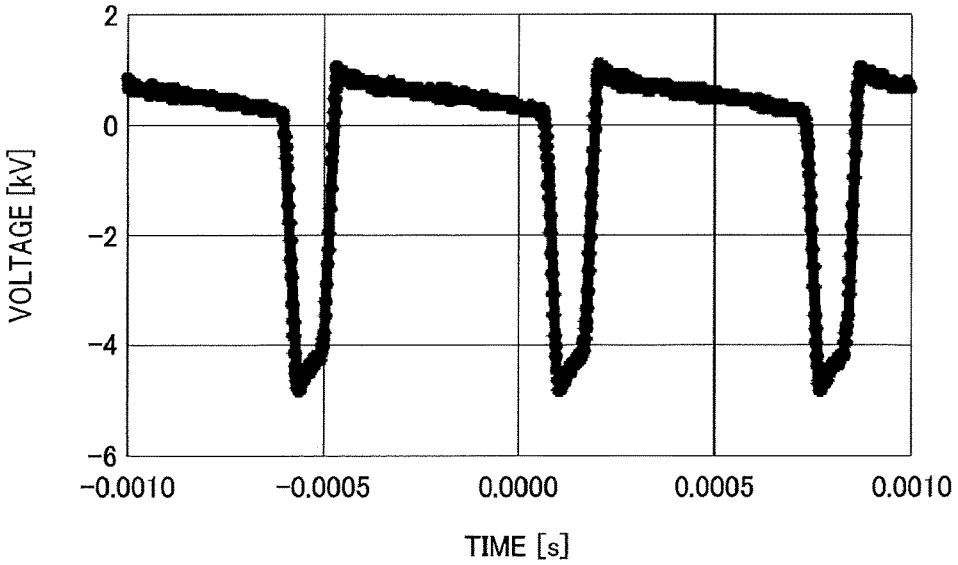
FIG. 7B is a waveform chart of an actual waveform of a voltage actually applied to obtain the ideal waveform illustrated in FIG. 7A.

FIG. 7B is a waveform chart of an actual waveform of a voltage actually applied to obtain the ideal waveform illustrated in FIG. 7A. An AC voltage, which has a waveform defined by the peak value Vt of −4.8 kV, the peak value Vr of 1.2 kV, Voff of −1.8 kV, Vave of 0.08 kV, Vpp of 6.0 kV, the duration A of the peak value Vt of 0.10 ms, the time period B of 0.66 ms, and the Duty of 85%, is applied.

A description is provided of an experiment to transfer a toner image on a recording medium P by using a machine having the construction of the image forming apparatus 500 according to the exemplary embodiment described above.

The experiment was performed under conditions below. As an environmental condition, a temperature was 27 degrees centigrade and a humidity was 80%. As a recording medium P, coated paper having a commercial product name MohawkColorCopyGloss was used. The coated paper had a paper weight of 270 gsm and a size of 457 mm×305 mm. A process linear velocity was 630 mm/s. An output toner image formed on the coated paper was a black halftone image. A length of the secondary transfer nip N in the rotation direction D31 of the intermediate transfer belt 31 was 4 mm. Alternatively, the secondary transfer bias as described above may be applied for the transfer of the toner image onto plain paper and recycled paper other than the coated paper.

Figure 8A:
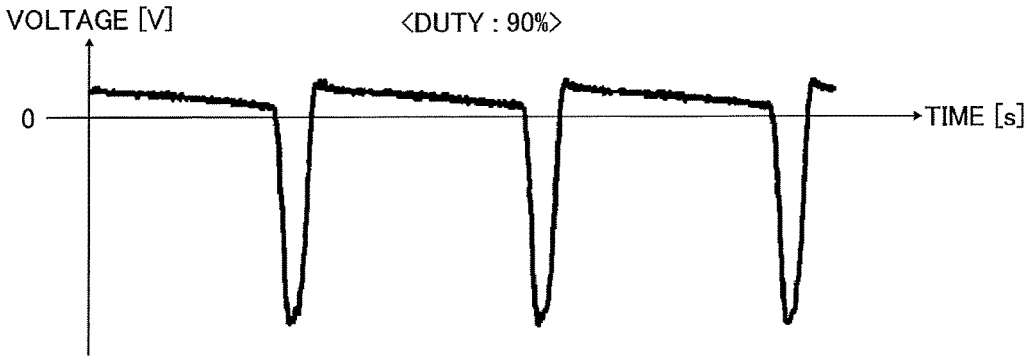
FIG. 8A is a graph illustrating a waveform under conditions illustrated in FIGS. 7A and 7B and a duty of 90%.
Figure 8B:
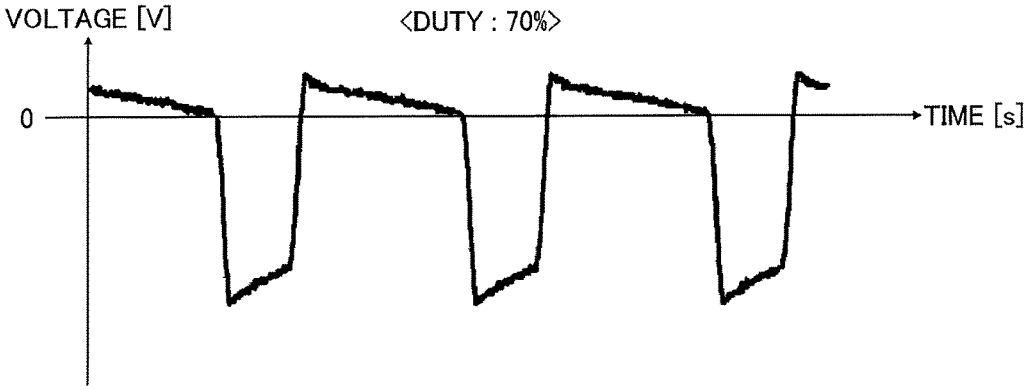
FIG. 8B is a graph illustrating a waveform under the conditions illustrated in FIGS. 7A and 7B and a duty of 70%.
Figure 8C:
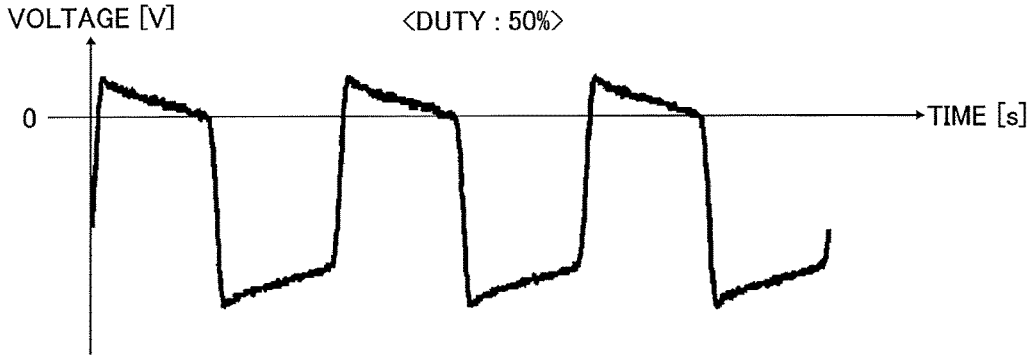
FIG. 8C is a graph illustrating a waveform under the conditions illustrated in FIGS. 7A and 7B and a duty of 50%.

FIG. 8A is a graph illustrating a waveform under the conditions illustrated in FIGS. 7A and 7B and a duty of 90%. FIG. 8B is a graph illustrating a waveform under the conditions illustrated in FIGS. 7A and 7B and a duty of 70%. FIG. 8C is a graph illustrating a waveform under the conditions illustrated in FIGS. 7A and 7B and a duty of 50%. FIG. 8D is a graph illustrating a waveform under the conditions illustrated in FIGS. 7A and 7B and a duty of 30%. FIG. 8E is a graph illustrating a waveform under the conditions illustrated in FIGS. 7A and 7B and a duty of 10%. FIG. 8F is a lookup table illustrating a grade under each duty. Halftone images were output with the waveforms illustrated in FIGS. 8A, 8B, 8C, 8D, and 8E. As illustrated in FIG. 8F, with the duty of 90% and 70%, a density of the halftone image was graded as grade 5. With the duty of 50%, a density of the halftone image was graded as grade 3. With the duty of 30% and 10%, a density of the halftone image was graded as grade 1.

The grade was defined as below. Grade 5 indicates that the density of the halftone image was sufficient. Grade 4 indicates that the density of the halftone image was slightly lower than that of grade 5, but the density of the halftone image was appropriate enough so as not to cause a problem, such as an image failure. Grade 3 indicates that the density of the halftone image was lower than that of grade 4 and desired image quality to satisfy users was not obtained. Grade 2 indicates that the density of the halftone image was lower than that of grade 3. Grade 1 indicates that the halftone image looked generally white or even whiter with less density. The acceptable image quality to satisfy users was defined as grade 4 or higher.

As described with reference to FIGS. 7A and 7B, with a low duty of 10% and 30%, a time period of application of a negative voltage that transfers the toner image onto the recording medium P is long, thereby overcharging the toner image, which degrades the transferability. In contrast, with a high duty of 70% and 90%, a time period of application of a negative voltage is short, thereby preventing overcharging of the toner image, which upgrades the transferability.

Further, reversing polarities of the peak value Vr of positive voltage and the peak value Vt of negative voltage in the waveforms reliably prevents overcharging of the toner image. This is because, in this configuration with crossing 0 V, even when the recording medium P is charged, the electric field is generated in a direction that prevents injection of charges.

As illustrated in FIGS. 3A and 4, the particles 103 dispersed on the outer circumferential surface of the intermediate transfer belt 31 enhance separation of the toner image from the intermediate transfer belt 31. For example, using the AC bias with a duty of 50% or less or the constant DC bias causes transfer failure of the halftone image. This is because the secondary transfer electric current leaks out from spaces between the particles 103, thereby overcharging toner of the halftone image. To address this circumstance, when the particles 103 are dispersed over the surface of the intermediate transfer belt 31, the secondary transfer bias with a high duty is employed to prevent transfer failure of the halftone image. Accordingly, separation of the toner of the toner image from the intermediate transfer belt 31 is enhanced and transfer failure is prevented.

If the particle 103 is a positively charged particle (e.g., a melamine particle), the positively charged particle offsets the secondary transfer bias that is negatively charged substantially, thus preventing the electric current from leaking from a space between the particles 103. Using this configuration with a high-duty waveform, that is, a high-duty secondary transfer bias, reliably prevents image failure due to the overcharged toner. If the particle 103 is a negatively charged particle (e.g., a Tospearl particle), the toner is susceptible to overcharging. To address this circumstance, the high-duty waveform is employed to prevent transfer failure.

With the intermediate transfer belt 31S coated with the coating layer 104 serving as a surface layer of the intermediate transfer belt 31S as illustrated in FIG. 3B and being made of urethane, Teflon®, or the like, the high-duty waveform is employed to prevent transfer failure. Alternatively, if the intermediate transfer belt 31 is constructed of a plurality of layers made of resins such as polyimide and polyamide-imide, the high-duty waveform is also employed to prevent transfer failure.

In order to attain transferability at recesses of a rough sheet, a low-duty AC transfer bias, that is, a superimposed transfer bias in which an AC component is superimposed on a DC component, is used effectively. For example, a low-duty waveform of 30% depicted in FIG. 8D or a low-duty waveform of 10% depicted in FIG. 8E is used with a waveform of Vpp of about 12 kV, thus attaining the transferability of the recesses of the rough sheet such as LEATHAC (product name) paper.

The image forming apparatus 500 has an image adjustment mode to adjust an image density of a toner image formed on a recording medium P. In the image adjustment mode, a signal indicating image data is generated. A toner pattern for adjustment of the image density is formed on the intermediate transfer belt 31. The toner pattern is hereinafter referred to as an adjustment pattern. The adjustment pattern is transferred not onto a recording medium P, but transferred onto the secondary transfer belt 36 at the secondary transfer nip N.

As illustrated in FIG. 1, the secondary transfer unit 41 includes a pattern detector 45 (e.g., a pattern sensor). In the image adjustment mode, the pattern detector 45 detects the image density of the adjustment pattern transferred onto the secondary transfer belt 36. In accordance with the image density detected by the pattern detector 45, a controller (e.g., the power source controller 200) carries out feed-back control (e.g., a process control) such that the image density of the adjustment pattern has a predetermined value. The condition of an image bearer (e.g., the secondary transfer belt 36) detected by the pattern detector 45 is identified by the image density of the adjustment pattern.

Figure 9:
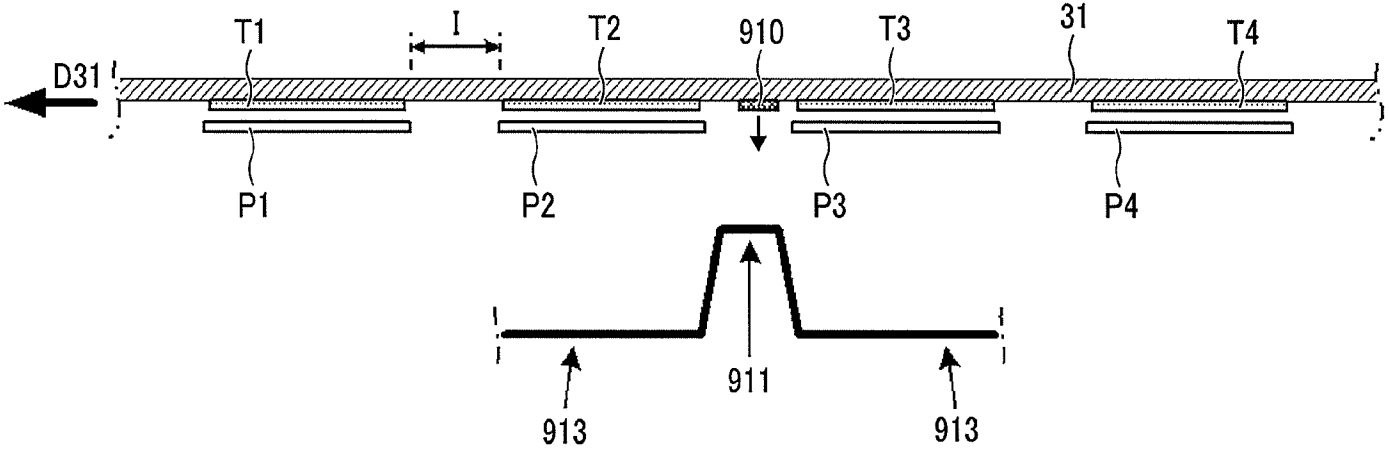
FIG. 9 is a cross-sectional view of the intermediate transfer belt depicted in FIG. 3A, which bears an adjustment pattern.

The controller performs the process control at a predetermined time, for example, whenever a predetermined time elapses or whenever a predetermined number of recording media P is printed. FIG. 9 is a cross-sectional view of the intermediate transfer belt 31 bearing an adjustment pattern 910 for explaining transfer of the adjustment pattern 910 at an interval I to be interposed between successive recording media P in the rotation direction D31 of the intermediate transfer belt 31 during successive printing.

As illustrated in FIG. 9, the intermediate transfer belt 31 bears toner images T1, T2, T3, and T4 (hereinafter also referred to as toner images T) to be transferred onto recording media P1, P2, P3, and P4 (hereinafter also referred to as recording media P) successively. The intermediate transfer belt 31 is rotatable in the rotation direction D31. The intermediate transfer belt 31 includes a first image portion (e.g., the image portion 902) to bear a first toner image (e.g., the toner image T2), a second image portion (e.g., the image portion 902) to bear a second toner image (e.g., the toner image T3), and a non-image portion (e.g., the non-image portion 901), interposed between the first image portion and the second image portion in the rotation direction D31 of the intermediate transfer belt 31, to bear the adjustment pattern 910.

The intermediate transfer belt 31 bears the adjustment pattern 910 used for the process control at a position between the toner image T2 and the toner image T3 in the rotation direction D31 of the intermediate transfer belt 31.

The power source controller 200 controls the secondary transfer power source 39 to output an image bias 913 as a transfer bias to transfer the first toner image (e.g., the toner image T2) and the second toner image (e.g., the toner image T3) onto the recording media P in the transfer nip N when the first image portion and the second image portion pass through the transfer nip N. The power source controller 200 controls the secondary transfer power source 39 to output a non-image bias 911 as the transfer bias when the non-image portion passes through the transfer nip N.

The secondary transfer back surface roller 33 depicted in FIG. 1 is applied with the image bias 913 that transfers the toner images T1, T2, T3, and T4 onto the recording media P1, P2, P3, and P4, respectively, when the first image portion and the second image portion pass through the transfer nip N. Conversely, the secondary transfer back surface roller 33 is applied with the non-image bias 911 when the non-image portion passes through the transfer nip N, that is, when the adjustment pattern 910 interposed between the toner image T2 and the toner image T3 is disposed opposite the secondary transfer back surface roller 33. The non-image bias 911 transfers the adjustment pattern 910 from the intermediate transfer belt 31 onto the secondary transfer belt 36. According to this exemplary embodiment, the pattern detector 45 detects the adjustment pattern 910 transferred onto the secondary transfer belt 36 to perform the process control.

Switching from the image bias 913 to the non-image bias 911 is performed within a short time period when the intermediate transfer belt 31 moves for the interval I between the adjacent toner images T. The time period corresponding to the interval I is a short time period of about 20 msec for a high speed image forming apparatus such as the image forming apparatus 500. If the image bias 913 does not switch to the non-image bias 911 within the short time period, the adjustment pattern 910 may fail to be transferred onto the secondary transfer belt 36. In this case, the process control is not performed precisely and therefore the toner image T is not formed on the recording medium P precisely.

A comparative control method may not switch from the image bias 913 to the target non-image bias 911 within the short time period and therefore the adjustment pattern 910 may fail to be transferred onto the secondary transfer belt 36. Switching from the image bias 913 to the non-image bias 911 within the short time period is difficult due to a first reason and a second reason below. The first reason is that a property of a power source that outputs the image bias 913 and the non-image bias 911 causes a time period for falling of output to be longer than a time period for rising of output. That is, a time period taken to attain a target output increases. In FIG. 9, switching from the image bias 913 to the non-image bias 911, that is, switching from a bottom to a top in FIG. 9, is defined as a fall. The second reason is that components, such as a roller and a belt, which form the secondary transfer nip N, work as a condenser that stores electric charges.

As described above, according to this exemplary embodiment, the adjustment pattern 910 is transferred from the intermediate transfer belt 31 onto the secondary transfer belt 36. The pattern detector 45 detects the adjustment pattern 910 on the secondary transfer belt 36. Accordingly, the secondary transfer bias switches from the image bias 913 to the target non-image bias 911 quickly within the time period corresponding to the interval I, thus transferring the adjustment pattern 910 onto the secondary transfer belt 36 precisely. Consequently, the image forming apparatus 500 performs the process control precisely, thus forming the toner image T on the recording medium P properly.

Figure 10:
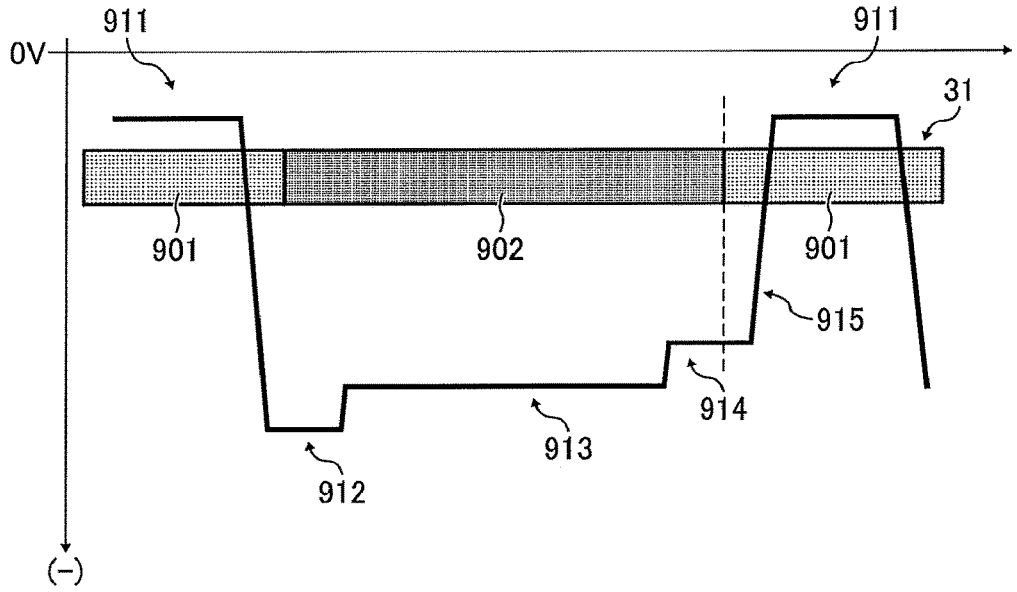
FIG. 10 is a diagram illustrating a control method for switching the secondary transfer bias, which is performed by the power source controller depicted in FIG. 5.

FIG. 10 is a diagram illustrating a control method for switching the secondary transfer bias according to this exemplary embodiment. As illustrated in FIG. 10, the intermediate transfer belt 31 is divided into a non-image portion 901 and an image portion 902. In order to switch from the image bias 913 to the non-image bias 911, while a trailing end of the image portion 902 in the rotation direction D31 of the intermediate transfer belt 31 passes over the secondary transfer back surface roller 33, the secondary transfer back surface roller 33 is applied with a trailing end correction bias 914 serving as a correction bias. The image bias 913 switches to the non-image bias 911 through the trailing end correction bias 914. The trailing end correction bias 914 corrects the secondary transfer bias from the image bias 913 to the non-image bias 911. As described below, a switch 915 switches constant current control for the image bias 913 to constant voltage control.

Figure 11:
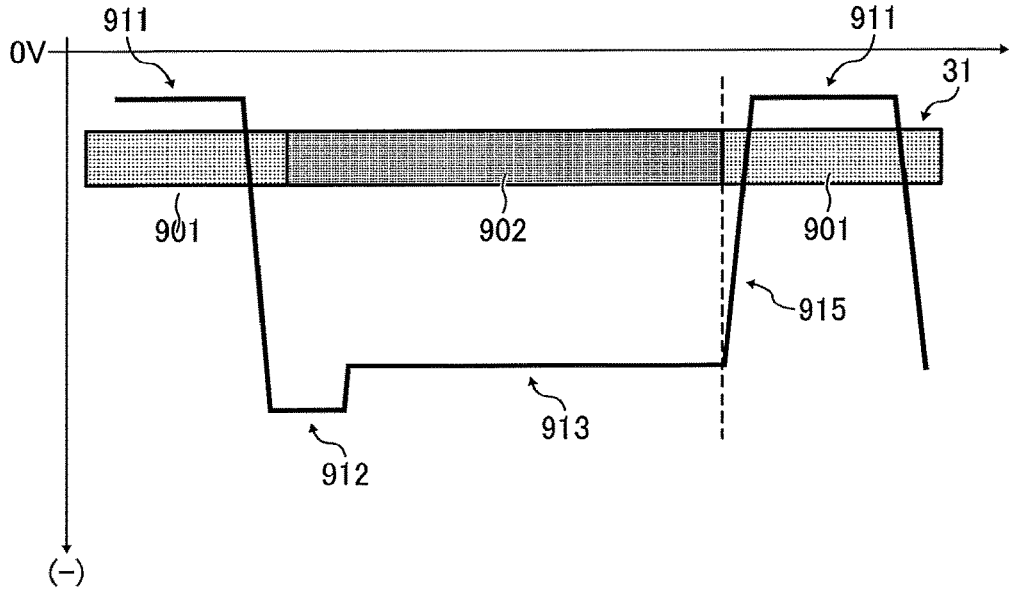
FIG. 11 is a diagram illustrating a control method for switching the secondary transfer bias, which is performed by the power source controller depicted in FIG. 5 without using a trailing end correction bias.

FIG. 11 is a diagram illustrating a control method for switching the secondary transfer bias without using the trailing end correction bias 914. The image bias 913 switches to the non-image bias 911 when the secondary transfer back surface roller 33 is disposed opposite a trailing edge of the image portion 902 of the intermediate transfer belt 31 in the rotation direction D31 thereof. In this case also, the switch 915 switches constant current control for the image bias 913 to constant voltage control.

Figure 12:
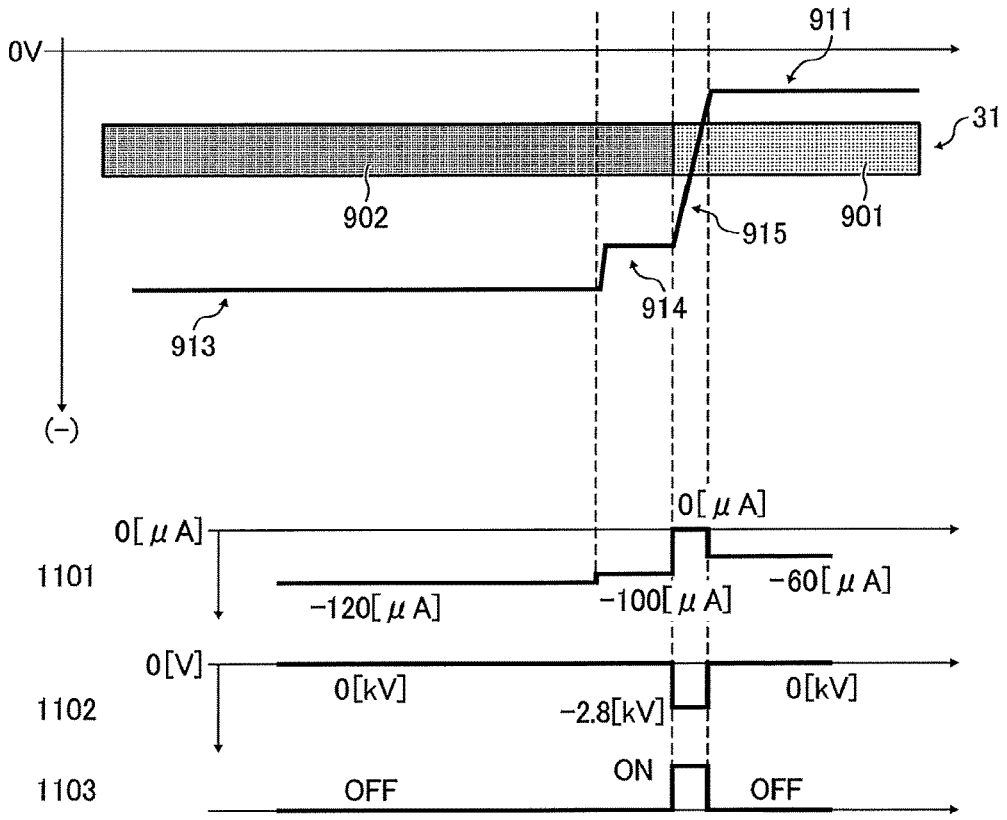
FIG. 12 is a diagram illustrating one example of a power source control method applied to the control method for switching the secondary transfer bias depicted in FIG. 10.

FIG. 12 is a diagram illustrating one example of a power source control method applied to the control method for switching the secondary transfer bias depicted in FIG. 10. During successive printing, the non-image portion 901 is interposed between the image portions 902 in the rotation direction D31 of the intermediate transfer belt 31. The adjustment pattern 910 is transferred from the non-image portion 901 of the intermediate transfer belt 31 onto the secondary transfer belt 36. For example, the non-image bias 911 is employed as the secondary transfer bias.

According to this exemplary embodiment, a constant voltage switch signal 1103 causes the secondary transfer power source 39 that applies the secondary transfer bias to selectively perform a constant current control 1101 and a constant voltage control 1102. When the constant voltage switch signal 1103 is on, the constant voltage control 1102 is selected.

As illustrated in FIG. 12, the switch 915 sets the constant current control 1101 of 0 μA, turns on the constant voltage switch signal 1103 for a switch time period, and sets the constant voltage control 1102 of −2.8 kV. Thereafter, the switch 915 turns off the constant voltage switch signal 1103 and sets the constant current control 1101 of −60 μA for the non-image bias 911. The image bias 913 is under the constant current control 1101 of −120 μA and the constant voltage control 1102 of 0 kV. The trailing end correction bias 914 is also under the constant current control 1101 of −100 μA and the constant voltage control 1102 of 0 kV.

If the intermediate transfer belt 31 bears a plurality of adjustment patterns 910, the non-image bias 911 may vary between the adjustment patterns 910. The secondary transfer bias is controlled to switch from the image bias 913 to the non-image bias 911 within a predetermined time period without delay in response of the secondary transfer power source 39. Thus, the secondary transfer back surface roller 33 applies a target secondary transfer bias to the non-image portion 901 of the intermediate transfer belt 31. Consequently, the power source controller 200 transfers the adjustment pattern 910 onto the secondary transfer belt 36 precisely, thus performing the process control precisely.

In FIG. 12, the power source controller 200 performs the constant current control 1101 on the non-image bias 911 like the power source controller 200 does on the image bias 913. It is because, like the image portion 902, even if change in resistance occurs in the intermediate transfer belt 31, the secondary transfer back surface roller 33, the secondary transfer belt 36, and the secondary transfer roller 400, the non-image bias 911 absorbs the change in resistance, forming the constant electric field at the secondary transfer nip N.

If the non-image portion 901 of the intermediate transfer belt 31 does not bear the adjustment pattern 910, the secondary transfer back surface roller 33 continues applying the image bias 913 to the intermediate transfer belt 31. Thus, a leading end of the toner image T to be transferred onto the subsequent recording medium P is immune from shortage of the secondary transfer bias. If the non-image portion 901 of the intermediate transfer belt 31 that does not bear the adjustment pattern 910 is applied with a bias different from a bias applied to the image portion 902 of the intermediate transfer belt 31, the power source controller 200 does not perform the control method depicted in FIG. 11 and switches control from the constant current control 1101 on the image portion 902 to the constant current control 1101 on the non-image portion 901. In this case, the power source controller 200 performs a simple control method, suppressing increase in control load.

Figure 13A:
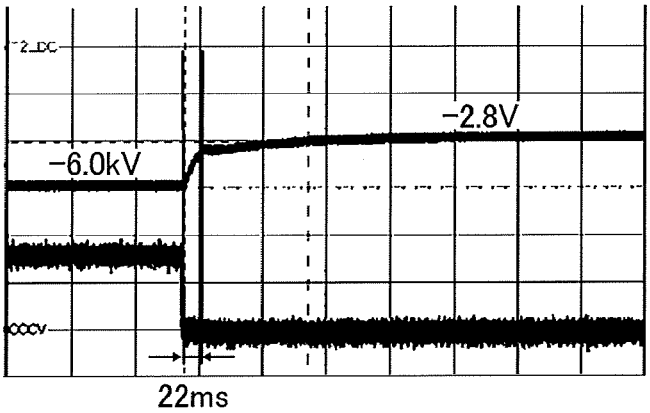
FIG. 13A is a diagram illustrating the control method for switching the secondary transfer bias, which is performed by the power source controller depicted in FIG. 5.
Figure 13B:
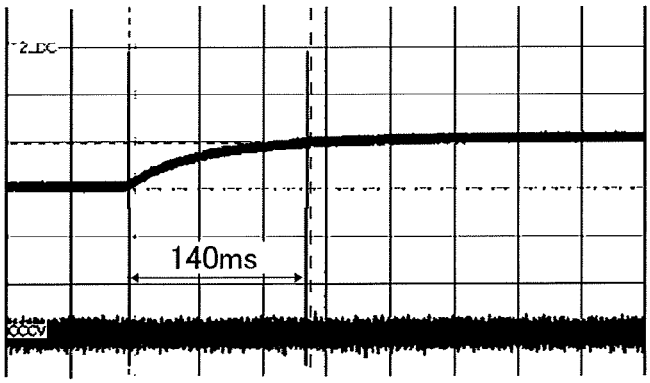
FIG. 13B is a diagram illustrating a comparative control method for switching the secondary transfer bias.

FIG. 13A is a diagram illustrating a control method for switching the secondary transfer bias according to this exemplary embodiment. FIG. 13B is a diagram illustrating a comparative control method for switching the secondary transfer bias. FIG. 13A illustrates a waveform output under the control method according to this exemplary embodiment. FIG. 13B illustrates a waveform output under the comparative control method. FIG. 13A illustrates the waveform output by the switch 915 depicted in FIG. 12.

Under the control method depicted in FIG. 13A, the image bias 913 of −6.0 kV switches to the non-image bias 911 of −2.8 kV for a switch time period of 22 msec. Conversely, under the comparative control method depicted in FIG. 13B, the image bias 913 of −6.0 kV switches to the non-image bias 911 of −2.8 kV for a switch time period of 140 msec. Comparison between the control method depicted in FIG. 13A and the comparative control method depicted in FIG. 13B indicates that the control method depicted in FIG. 13A shortens a time period of the switch 915 substantially.

Figure 14:
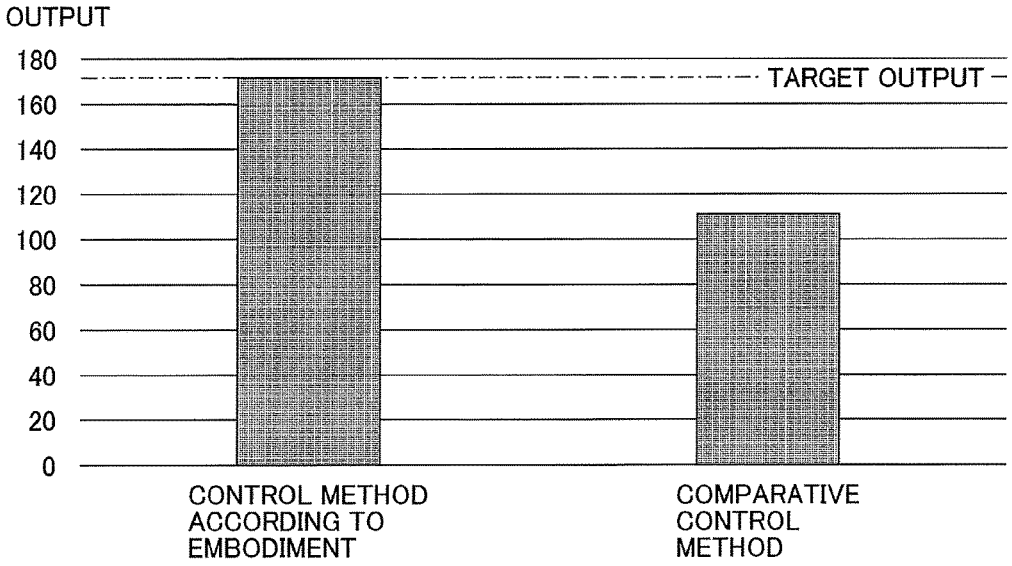
FIG. 14 is a graph illustrating detection results of detection of the adjustment pattern on a secondary transfer belt incorporated in the image forming apparatus depicted in FIG. 1 under the control method depicted in FIG. 13A and the comparative control method depicted in FIG. 13B.

FIG. 14 is a graph illustrating detection results of detection of the adjustment pattern 910 on the secondary transfer belt 36 under the control method for switching the secondary transfer bias according to this exemplary embodiment and the comparative control method. As illustrated in FIG. 14, under the control method according to this exemplary embodiment, the pattern detector 45 detects a target output. Conversely, under the comparative control method, the pattern detector 45 detects an output lower than the target output. Under the comparative control method, since the adjustment pattern 910 is not transferred stably, the pattern detector 45 detects faulty toner patches constituting the adjustment pattern 910. Conversely, under the control method according to this exemplary embodiment, the output detected by the pattern detector 45 is identical to the target output. Thus, the control method according to this exemplary embodiment controls switching of the secondary transfer bias precisely.

Figure 15:
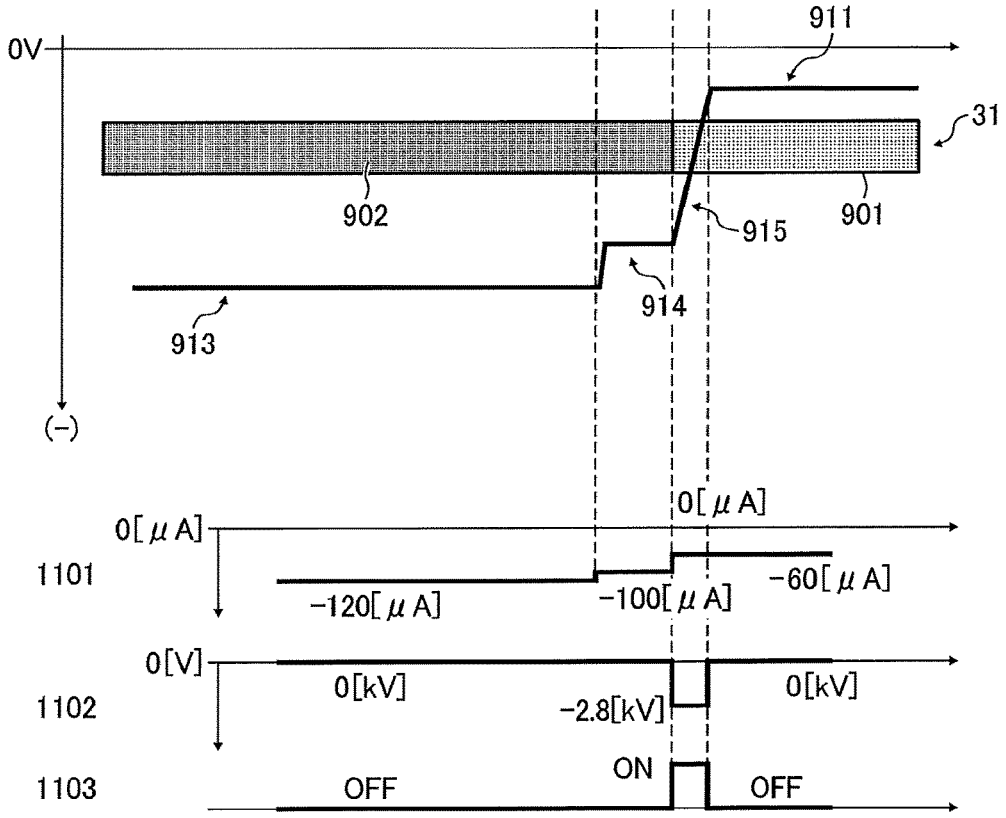
FIG. 15 is a diagram illustrating another example of the power source control method applied to the control method for switching the secondary transfer bias depicted in FIG. 10.

FIG. 15 is a diagram illustrating another example of the power source control method applied to the control method for switching the secondary transfer bias depicted in FIG. 10. The example of the power source control method depicted in FIG. 15 is different from the example of the power source control method depicted in FIG. 12 in that the constant current control 1101 is not 0 μA at the switch 915 but is −60 μA that is common to the non-image bias 911. Other configuration is equivalent to the configuration of the power source control method depicted in FIG. 12.

The power source control method depicted in FIG. 15 decreases a number of switching compared to the power source control method depicted in FIG. 12, thus reducing control load. When the constant voltage switch signal 1103 is on, the constant voltage control 1102 is output and the constant current control 1101 is not output, generating no contradiction in control.

Figure 16:
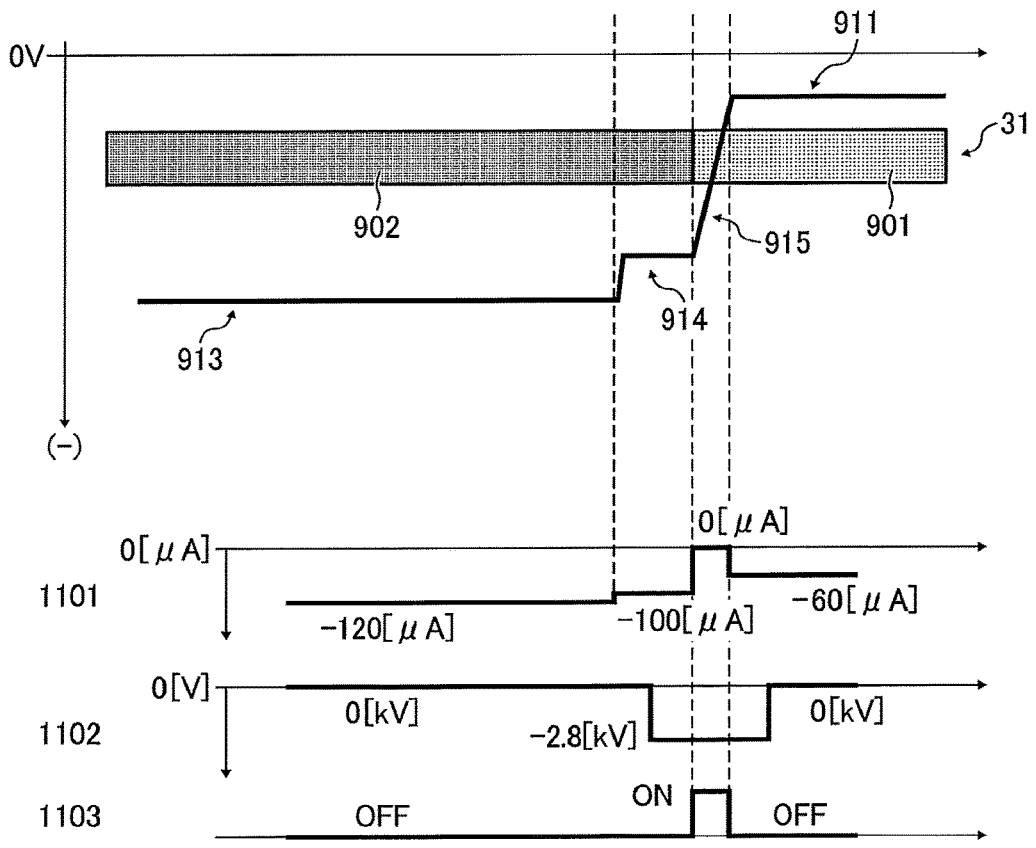
FIG. 16 is a diagram illustrating yet another example of the power source control method applied to the control method for switching the secondary transfer bias depicted in FIG. 10.

FIG. 16 is a diagram illustrating yet another example of the power source control method applied to the control method for switching the secondary transfer bias depicted in FIG. 10. The example of the power source control method depicted in FIG. 16 is different from the example of the power source control method depicted in FIG. 12 in that the constant voltage control 1102 is turned on before the constant voltage switch signal 1103 is turned on and that the constant voltage control 1102 is turned off after the constant voltage switch signal 1103 is turned off. Other configuration is equivalent to the configuration of the power source control method depicted in FIG. 12.

Even if delay in processing occurs in software for controlling the constant voltage control 1102, the constant voltage control 1102 is turned on before the constant voltage switch signal 1103 is turned on, allowing the secondary transfer power source 39 to output the constant voltage precisely. Additionally, the power source control method is designed without considering delay in response of the secondary transfer power source 39 for the constant voltage control 1102. Thus, the power source control method is simplified. When the constant voltage switch signal 1103 is off, the constant voltage control 1102 is not output, generating no contradiction in control.

Figure 17:
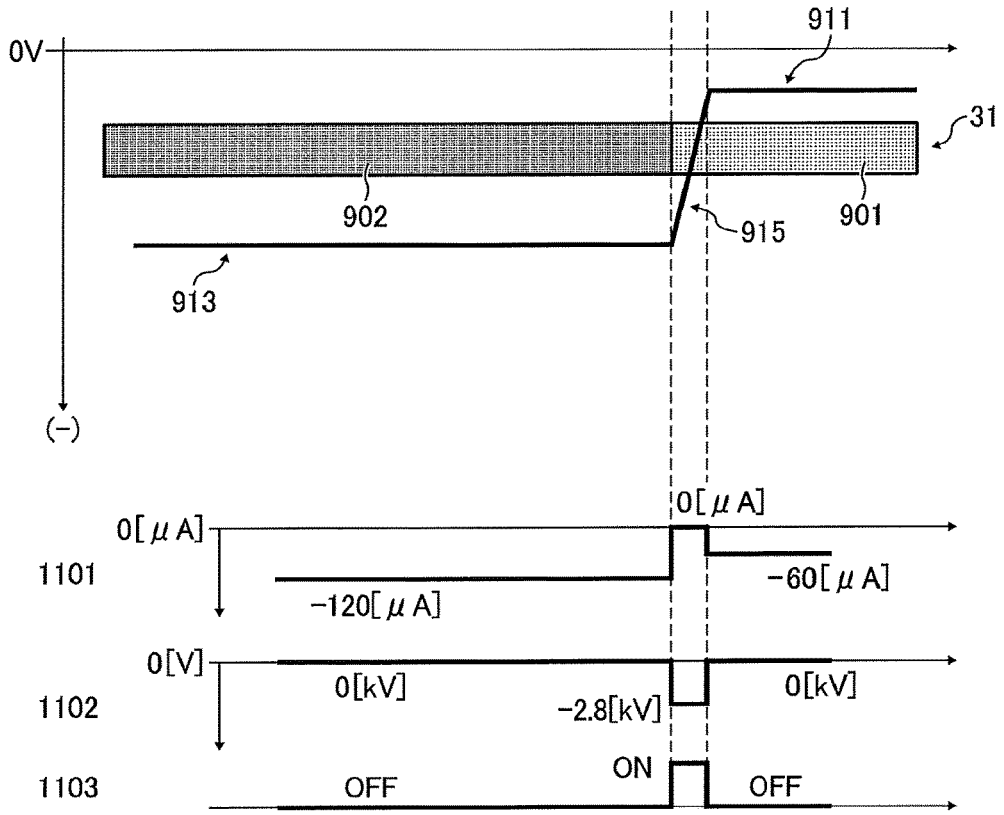
FIG. 17 is a diagram illustrating one example of a power source control method corresponding to the control method for switching the secondary transfer bias depicted in FIG. 11.

FIG. 17 is a diagram illustrating one example of a power source control method corresponding to the control method for switching the secondary transfer bias depicted in FIG. 11. The power source control method depicted in FIG. 17 does not involve the trailing end correction bias 914, that is, a correction bias applied to the trailing end of the image portion 902 of the intermediate transfer belt 31. The constant current control 1101 changes from −120 μA to 0 μA to switch the image bias 913 to the non-image bias 911.

Figure 18:
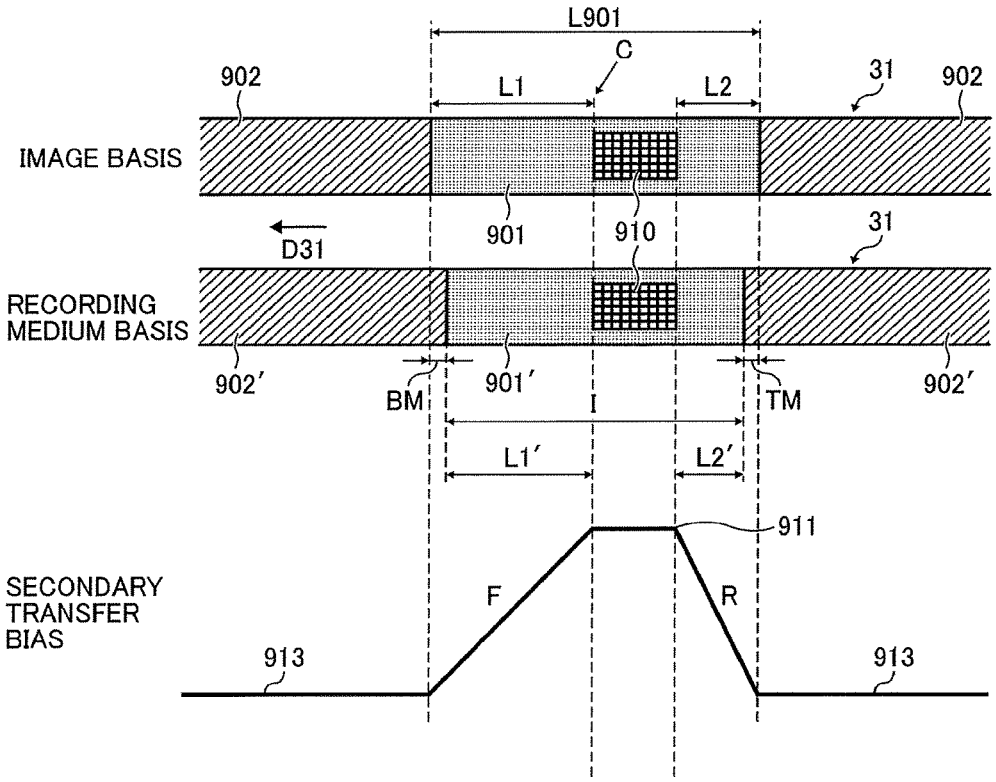
FIG. 18 is a diagram illustrating switching of the secondary transfer bias at an interval where the intermediate transfer belt bears the adjustment pattern, which is performed on an image basis and a recording medium basis.

FIG. 18 is a diagram illustrating switching of the secondary transfer bias at the interval I where the intermediate transfer belt 31 bears the adjustment pattern 910, which is performed on an image basis that is based on a toner image T and a recording medium basis that is based on a recording medium P. An upper part of FIG. 18 illustrates the intermediate transfer belt 31 sectioned on the image basis. A medium part of FIG. 18 illustrates the intermediate transfer belt 31 sectioned on the recording medium basis. A lower part of FIG. 18 illustrates the secondary transfer bias. In the upper part of FIG. 18, the non-image portion 901 of the intermediate transfer belt 31 bears the adjustment pattern 910. In the medium part of FIG. 18, a non-image portion 901' of the intermediate transfer belt 31 bears the adjustment pattern 910.

A description is provided of switching of the secondary transfer bias on the image basis.

As illustrated in FIG. 18, the image portion 902 of the intermediate transfer belt 31 bears a toner image T. The non-image portion 901 where the toner image T is not formed is interposed between the left, preceding image portion 902 and the right, subsequent image portion 902. The non-image portion 901 bears the adjustment pattern 910. As illustrated in the lower part of FIG. 18, the image bias 913 is applied to the image portion 902. The non-image bias 911 is applied to the adjustment pattern 910. That is, the secondary transfer bias switches from the image bias 913 through the non-image bias 911 to the image bias 913. Switching from the image bias 913 to the non-image bias 911 is defined as a fall F. Switching from the non-image bias 911 to the image bias 913 is defined as a rise R.

A description is provided of switching of the secondary transfer bias on the recording medium basis.

A recording medium P generally has a top margin at a leading end of the recording medium P. Hence, a leading edge of an image section where a toner image T is formed is disposed downstream from the leading end of the recording medium P in the rotation direction D31 of the intermediate transfer belt 31. The recording medium P does or does not have a bottom margin at a trailing end of the recording medium P. If the recording medium P does not have the bottom margin at the trailing end of the recording medium P, a trailing edge of the recording medium P coincides with a trailing edge of the image section. FIG. 18 illustrates the recording medium P having the bottom margin. In the medium part of FIG. 18, the interval portion 901', that is, the interval I, is interposed between a preceding recording medium 902' and a subsequent recording medium 902' in the rotation direction D31 of the intermediate transfer belt 31. The recording medium 902' illustrated in FIG. 18 has a top margin TM and a bottom margin BM. Accordingly, the bottom margin BM of the preceding recording medium 902' and the top margin TM of the subsequent recording medium 902' overlap the interval portion 901'. In this case also, the secondary transfer bias switches between the non-image bias 911 and the image bias 913. The secondary transfer bias switches based on the image basis. Accordingly, start of the fall F precedes a trailing edge of the preceding recording medium 902'. Finish of the rise R is after a leading edge of the subsequent recording medium 902'.

As described above, when the power source controller 200 switches the secondary transfer bias, the configuration of the secondary transfer nip N and the property of the secondary transfer power source 39 cause the time period taken for the fall F of output of the secondary transfer bias to be longer than the time period taken for the rise R. In the lower part of FIG. 18, switching from the image bias 913 to the non-image bias 911, that is, switching from a bottom to a top in the lower part of FIG. 18, is defined as the fall F. The time period taken for the fall F is longer than the time period taken for the rise R to attain the target output.

To address this circumstance, according to this exemplary embodiment, the adjustment pattern 910 is not situated at a center C of each of the non-image portion 901 on the image basis and the interval portion 901' on the recording medium basis, but is situated downstream from the center C in the rotation direction D31 of the intermediate transfer belt 31, that is, on the right of the center C in FIG. 18. For example, the power source controller 200 controls a time to write the adjustment pattern 910 on the photoconductors 2Y, 2M, 2C, and 2K depicted in FIG. 1 so that the adjustment pattern 910 is transferred onto the intermediate transfer belt 31 at a position downstream from the center C in the rotation direction D31 of the intermediate transfer belt 31. Accordingly, as illustrated in FIG. 18, in the non-image portion 901 having a length L901, a distance L1 interposed between the image portion 902 bearing a preceding toner image and the adjustment pattern 910 in the rotation direction D31 of the intermediate transfer belt 31 is greater than a distance L2 interposed between the adjustment pattern 910 and the image portion 902 bearing a subsequent toner image in the rotation direction D31 of the intermediate transfer belt 31 on the image basis. A distance L1' interposed between the preceding recording medium 902' and the adjustment pattern 910 in the rotation direction D31 of the intermediate transfer belt 31 is greater than a distance L2' interposed between the adjustment pattern 910 and the subsequent recording medium 902' in the rotation direction D31 of the intermediate transfer belt 31 on the recording medium basis. The adjustment pattern 910 disposed on the intermediate transfer belt 31 as described above increases a time spared to switch the secondary transfer bias from the image bias 913 to the non-image bias 911. Accordingly, compared to the control methods illustrated in FIGS. 10 and 11 and the power source control methods illustrated in FIGS. 12, 15, 16, and 17, the adjustment pattern 910 disposed on the intermediate transfer belt 31 as illustrated in FIG. 18 increases the time spared to switch the secondary transfer bias from the image bias 913 to the non-image bias 911, thus allowing the non-image bias 911 to attain a target value more precisely.

The fall F depicted in FIG. 18 is equivalent to the switch 915 depicted in FIGS. 10 to 12 and FIGS. 15 to 17. As described above, the switch 915 switches constant current control for the image bias 913 to constant voltage control. Additionally, if the intermediate transfer belt 31 bears the adjustment pattern 910, constant voltage control is preferable for the rise R after the adjustment pattern 910, that is, switching from the non-image bias 911 to the image bias 913, thus preventing transfer failure (e.g., insufficient density) of the leading end of the toner image T on the subsequent recording medium 902'.

Figure 19:
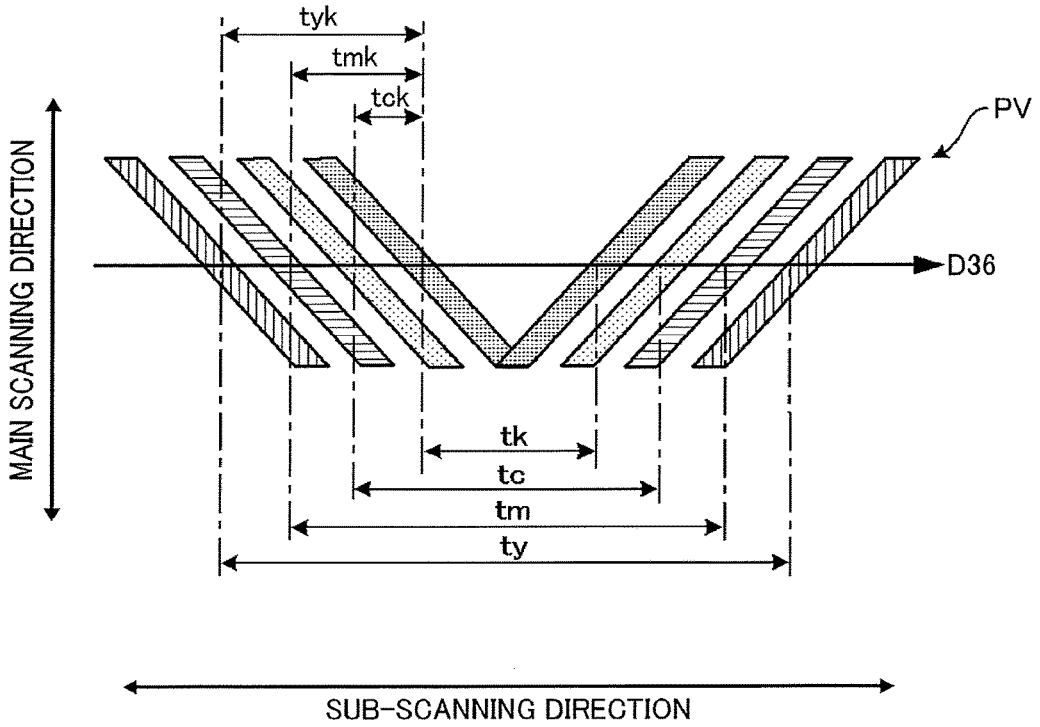
FIG. 19 is a plan view of a chevron patch formed on the secondary transfer belt incorporated in the image forming apparatus depicted in FIG. 1.

The image forming apparatus 500 according to this exemplary embodiment performs a color shift amount correction process whenever the image forming apparatus 500 is powered on or a predetermined number of prints is performed. In the color shift amount correction process, as illustrated in FIG. 19, a color shift detection image called a chevron patch PV is transferred onto one lateral end and another lateral end of the secondary transfer belt 36 in a width direction thereof that is perpendicular to a rotation direction D36 of the secondary transfer belt 36. FIG. 19 is a plan view of the chevron patch PV. As illustrated in FIG. 19, the chevron patch PV is constructed of yellow, magenta, cyan, and black toner images.

The chevron patch PV is a group of line patterns in which the yellow, magenta, cyan, and black toner images are arranged with a predetermined pitch between the adjacent toner images in a sub-scanning direction, that is, the rotation direction D36 of the secondary transfer belt 36. The yellow, magenta, cyan, and black toner images are tilted relative to a main scanning direction by about 45 degrees. An amount of toner adhered to the chevron patch PV is about 0.3 [mg/cm$^2$].

The pattern detector 45 depicted in FIG. 1 detects the yellow, magenta, cyan, and black toner images of the chevron patch PV to detect a position in the main scanning direction, that is, an axial direction of each of the photoconductors 2Y, 2M, 2C, and 2K, a position in the sub-scanning direction, that is, the rotation direction D36 of the secondary transfer belt 36, a magnification error in the main scanning direction, and a skew from the main scanning direction of each of the yellow, magenta, cyan, and black toner images of the chevron patch PV. The main scanning direction defines a direction in which a laser beam reflected by a polygon mirror of the optical writing unit 80 depicted in FIG. 1 is phased on an outer circumferential surface of each of the photoconductors 2Y, 2M, 2C, and 2K.

The pattern detector 45 reads a detection time difference between a detection time of the yellow, magenta, and cyan toner images and a detection time of the black toner image of the chevron patch PV. In FIG. 19, a vertical direction is equivalent to the main scanning direction. The yellow, magenta, cyan, and black toner images are aligned from the left in FIG. 19. The black, cyan, magenta, and yellow toner images are aligned on the right in FIG. 19 and angled symmetrically relative the yellow, magenta, cyan, and black toner images on the left by 90 degrees. In FIG. 19, a length tk defines a length between the left black toner image and the right black toner image in the sub-scanning direction. A length tc defines a length between the left cyan toner image and the right cyan toner image in the sub-scanning direction. A length tm defines a length between the left magenta toner image and the right magenta toner image in the sub-scanning direction. A length ty defines a length between the left yellow toner image and the right yellow toner image in the sub-scanning direction.

The power source controller 200 depicted in FIG. 5 calculates a shift amount, that is, a registration shift amount, of each of the yellow, magenta, and cyan toner images in the sub-scanning direction based on a difference between a measured value and a theoretical value for detection time differences tyk, tmk, and tck in detection of the yellow, magenta, and cyan toner images from detection of the black toner image serving as a toner image of a reference color. Based on the calculated registration shift amount, the power source controller 200 corrects an optical writing start time when the optical writing unit 80 starts optical writing on each of the photoconductors 2Y, 2M, 2C, and 2K per unit time defined by each face of the polygon mirror of the optical writing unit 80, that is, a single scanning line pitch, thus reducing the registration shift amount of each of the yellow, magenta, and cyan toner images. Based on a difference in the registration shift amount of each of the yellow, magenta, and cyan toner images in the sub-scanning direction between both lateral ends of the secondary transfer belt 36 in the width direction thereof, the power source controller 200 calculates skew of each of the yellow, magenta, and cyan toner images relative to the main scanning direction. Based on the calculated skew of the yellow, magenta, and cyan toner images, the power source controller 200 corrects optical face tangle error of reflection mirrors of the optical writing unit 80, thus reducing skew of each of the yellow, magenta, and cyan toner images.

As described above, the color shift correction process defines a process to correct the optical writing start time and the optical face tangle error based on a detection time when the pattern detector 45 detects each of the yellow, magenta, cyan, and black toner images of the chevron patch PV, thus reducing the registration skew amount and the skew of the yellow, magenta, and cyan toner images. The color shift correction process suppresses shifting of yellow, magenta, cyan, and black toner images to be formed into a color toner image as an output toner image, which occurs as the yellow, magenta, cyan, and black toner images transferred onto the intermediate transfer belt 31 shift from each other over time due to temperature change and the like.

As illustrated in FIG. 18, if the adjustment pattern 910 used to detect color shift is interposed between the image portions 902 that bear a first toner image and a second toner image, respectively, on the intermediate transfer belt 31 serving as an image bearer in the rotation direction D31 thereof, the image bias 913 applied to the image portions 902 that bear the first toner image and the second toner image, respectively, is different from the non-image bias 911 applied to the non-image portion 901 interposed between the image portions 902. Additionally, the power source controller 200 performs constant current control on the image bias 913 and performs constant voltage control when the image bias 913 switches to the non-image bias 911.

If the adjustment pattern 910 used to detect color shift is transferred at the interval portion 901' interposed between the preceding recording medium 902' and the subsequent recording medium 902' during successive printing, the image bias 913 that transfers the first toner image and the second toner image on the intermediate transfer belt 31 onto the recording media 902', respectively, is different from the non-image bias 911 that transfers the adjustment pattern 910 onto the secondary transfer belt 36 at the interval I to be interposed between the preceding recording medium 902' and the subsequent recording medium 902'. Additionally, the power source controller 200 performs constant current control on the image bias 913 and performs constant voltage control when the image bias 913 switches to the non-image bias 911. Consequently, the power source controller 200 transfers the adjustment pattern 910 onto the secondary transfer belt 36 precisely, thus performing adjustment control precisely and outputting the first toner image and the second toner image onto the recording media 902' properly.

As described above, the power source controller 200 of the image forming apparatus 500 according to the present disclosure switches the secondary transfer bias from the image bias 913 to the target non-image bias 911 quickly. Accordingly, the image forming apparatus 500 transfers the adjustment pattern 910 onto the secondary transfer belt 36 precisely, thus performing adjustment control precisely and outputting the first toner image and the second toner image on the recording media P properly.

FIG. 5 illustrates the configuration of the secondary transfer power source 39 incorporating the AC power source 140 detachably attached to the secondary transfer power source 39. However, the configuration of the secondary transfer power source 39 is not limited to the configuration illustrated in FIG. 5. For example, the secondary transfer power source 39 may incorporate an AC power source not detachably attached to the secondary transfer power source 39 or may incorporate the DC power source 110 but not incorporate the AC power source 140, thus attaining the advantages described above.

The power source controller 200 performs constant voltage control when switching the secondary transfer bias from the non-image bias 911 applied to the adjustment pattern 910 to the image bias 913 applied to the toner image, thus preventing insufficient density of the leading end of the toner image disposed downstream from the adjustment pattern 910 in the rotation direction D31 of the intermediate transfer belt 31.

The secondary transfer power source 39 includes the DC power source 110 that outputs a DC component and the AC power source 140 that outputs an AC component. When switching the secondary transfer bias from the image bias 913 to the non-image bias 911, the power source controller 200 performs constant voltage control on the DC component of the secondary transfer bias, thus suppressing degradation in response of the DC power source 110 caused by the AC power source 140 and switching output of the DC power source 110 to the target non-image bias 911 quickly.

As illustrated in FIG. 18, the distance L1 is interposed between the preceding, the first toner image in the image portion 902 and the adjustment pattern 910 in the rotation direction D31 of the intermediate transfer belt 31. The distance L2 is interposed between the adjustment pattern 910 and the subsequent, second toner image in the image portion 902 in the rotation direction D31 of the intermediate transfer belt 31. The distance L1 being greater than the distance L2 increases the time spared to switch the secondary transfer bias from the image bias 913 to the non-image bias 911. Accordingly, the non-image bias 911 attains the target value more precisely.

The distance L1' is interposed between the preceding recording medium 902' and the adjustment pattern 910 in the rotation direction D31 of the intermediate transfer belt 31. The distance L2' is interposed between the adjustment pattern 910 and the subsequent recording medium 902' in the rotation direction D31 of the intermediate transfer belt 31. The distance L1' being greater than the distance L2' increases the time spared to switch the secondary transfer bias from the image bias 913 to the non-image bias 911. Accordingly, the non-image bias 911 attains the target value more precisely.

Additionally, if the intermediate transfer belt 31 does not bear the adjustment pattern 910 between the first toner image and the second toner image, the image bias 913 is equivalent to the non-image bias 911 to prevent transfer failure (e.g., insufficient density) of the leading end of the second toner image on the subsequent recording medium 902'.

As illustrated in FIG. 1, the image forming apparatus 500 includes the intermediate transfer belt 31 serving as an image bearer and an intermediate transferor and the secondary transfer belt 36 serving as a secondary transferor. The secondary transfer belt 36 and the intermediate transfer belt 31 form the secondary transfer nip N. The power source controller 200 performs an adjustment control as below. The secondary transfer back surface roller 33 serving as a transferor transfers the adjustment pattern 910 from the intermediate transfer belt 31 onto the secondary transfer belt 36. The pattern detector 45 detects the adjustment pattern 910 on the secondary transfer belt 36. The power source controller 200 transfers the adjustment pattern 910 onto the secondary transfer belt 36 precisely, thus performing adjustment control precisely.

As illustrated in FIGS. 10, 12, 15, and 16, when the power source controller 200 switches the secondary transfer bias from the image bias 913 to the non-image bias 911 that transfers the adjustment pattern 910, the power source controller 200 switches the secondary transfer bias through the trailing end correction bias 914 serving as a correction bias that is directed to the non-image bias 911, thus allowing the non-image bias 911 to attain the target value more precisely.

As illustrated in FIG. 3A, even if the intermediate transfer belt 31 is a multi-layer belt having an interface which lengthens a switch time period when the secondary transfer bias switches from the image bias 913 to the non-image bias 911 compared to a single-layer intermediate transfer belt, the power source controller 200 switches the secondary transfer bias from the image bias 913 to the non-image bias 911 quickly.

As illustrated in FIG. 3A, since the intermediate transfer belt 31 includes the plurality of particles 103 dispersed on the surface of the elastic layer 102, the particles 103 may work as a condenser which lengthens the switch time period when the secondary transfer bias switches from the image bias 913 to the non-image bias 911 compared to the single-layer intermediate transfer belt. However, the power source controller 200 switches the secondary transfer bias from the image bias 913 to the target non-image bias 911 quickly.

The particles 103 dispersed on the surface of the elastic layer 102 may be charged positively. However, the power source controller 200 switches the secondary transfer bias from the image bias 913 to the target non-image bias 911 quickly. Conversely, the particles 103 dispersed on the surface of the elastic layer 102 may be charged negatively. However, the power source controller 200 switches the secondary transfer bias from the image bias 913 to the target non-image bias 911 quickly.

As illustrated in FIG. 3B, the elastic layer 102 may be coated with the coating layer 104. However, the power source controller 200 switches the secondary transfer bias from the image bias 913 to the target non-image bias 911 quickly. The intermediate transfer belt 31 may include a plurality of resin layers. However, the power source controller 200 switches the secondary transfer bias from the image bias 913 to the target non-image bias 911 quickly.

The configurations of the image forming apparatus 500 and the control methods performed by the image forming apparatus 500 are not limited to those of the exemplary embodiments described above. For example, the transfer unit 30 serving as a transfer device and the secondary transfer power source 39 may adopt configurations that are different from the configurations described above.

The configuration of each component of the image forming apparatus 500 is also arbitrary. The order of alignment of the image forming units 1Y, 1M, 1C, and 1K of a tandem system is also arbitrary. The image forming apparatus 500 uses toners in four colors. Alternatively, the image forming apparatus 500 may be a full-color image forming apparatus using toners in three colors or a multi-color image forming apparatus using toners in two colors. The image forming apparatus 500 is not limited to a printer. The image forming apparatus 500 may be a copier, a facsimile machine, or a multifunction peripheral having a plurality of functions.

A description is provided of advantages of the image forming apparatus 500.

As illustrated in FIGS. 1 and 5, the image forming apparatus 500 includes an image bearer (e.g., the intermediate transfer belt 31), a transferor (e.g., the secondary transfer back surface roller 33), a power source (e.g., the secondary transfer power source 39 incorporating the AC power source 140 and the DC power source 110), and a controller (e.g., the power source controller 200).

As illustrated in FIG. 18, the image bearer bears a first toner image in a first image portion (e.g., the image portion 902) and a second toner image in a second image portion (e.g., the image portion 902). As illustrated in FIG. 1, the image bearer and a secondary transferor (e.g., the secondary transfer belt 36) form a transfer nip (e.g., the secondary transfer nip N) therebetween. The power source outputs a transfer bias to transfer the first toner image and the second toner image onto a first recording medium and a second recording medium, respectively, at the transfer nip. The controller controls the power source.

As illustrated in FIG. 18, the image bearer bears an adjustment pattern (e.g., the adjustment pattern 910) in a non-image portion (e.g., the non-image portion 901) interposed between the first image portion and the second image portion in a rotation direction (e.g., the rotation direction D31) of the image bearer. The transfer bias includes an image bias (e.g., the image bias 913) applied to the image portion of the image bearer and a non-image bias (e.g., the non-image bias 911) applied to the non-image portion of the image bearer. The non-image bias is different from the image bias. The controller performs constant current control on the image bias and performs constant voltage control when the image bias switches to the non-image bias.

The transfer bias transfers the adjustment pattern on an interval portion (e.g., the interval portion 901') of the image bearer, which is interposed between the first recording medium and the second recording medium during successive printing. The image bias transfers the first toner image and the second toner image onto the first recording medium and the second recording medium, respectively. The non-image bias transfers the adjustment pattern onto the secondary transferor. The non-image bias is different from the image bias. The controller performs constant current control on the image bias and performs constant voltage control when the image bias switches to the non-image bias.

Accordingly, the image forming apparatus 500 switches the transfer bias from the image bias to the target non-image bias quickly. For example, when transferring the adjustment pattern, the transfer bias switches to a bias that is appropriate for transferring the adjustment pattern within a shortened time period. Consequently, the image forming apparatus 500 transfers the adjustment pattern onto the secondary transferor precisely, thus performing precise adjustment control and properly outputting the first toner image and the second toner image onto the first recording medium and the second recording medium, respectively.

The advantages achieved by the exemplary embodiments described above are examples and therefore are not limited to those described above.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present invention.

Any one of the above-described operations may be performed in various other ways, for example, in an order different from the one described above.

What is claimed is:

1. An image forming apparatus comprising:

an image bearer rotatable in a rotation direction and including:

a first image portion to bear a first toner image;

a second image portion to bear a second toner image; and a non-image portion, interposed between the first image portion and the second image portion in the rotation direction of the image bearer, to bear an adjustment pattern;

a transferor to form a transfer nip with the image bearer;

at least one power source to output a transfer bias; and a controller to control the power source to output an image bias as the transfer bias to transfer the first toner image and the second toner image onto a first recording medium and a second recording medium subsequent to the first recording medium, respectively, in the transfer nip when the first image portion and the second image portion pass through the transfer nip, the controller to control the power source to output a non-image bias as the transfer bias when the non-image portion passes through the transfer nip, the non-image bias being different from the image bias, the controller to perform a constant current control on the image bias and perform a constant voltage control when the image bias switches to the non-image bias.

2. The image forming apparatus according to claim 1, further comprising a secondary transferor to form the transfer nip between the image bearer and the secondary transferor.

3. The image forming apparatus according to claim 2, wherein the power source outputs the non-image bias to the non-image portion of the image bearer to transfer the adjustment pattern onto the secondary transferor, and wherein the non-image portion is interposed between the first recording medium and the second recording medium in the transfer nip during successive printing.

4. The image forming apparatus according to claim 3, wherein a first distance is interposed between the adjustment pattern and the first recording medium in the rotation direction of the image bearer, wherein a second distance is interposed between the adjustment pattern and the second recording medium in the rotation direction of the image bearer, and wherein the first distance is greater than the second distance.

5. The image forming apparatus according to claim 2, further comprising a pattern detector to detect the adjustment pattern, wherein the image bearer includes an intermediate transferor from which the adjustment pattern is transferred onto the secondary transferor, and wherein the pattern detector detects the adjustment pattern transferred onto the secondary transferor.

6. The image forming apparatus according to claim 1, wherein the controller performs the constant voltage control when the controller switches the transfer bias from the non-image bias output to the adjustment pattern to the image bias output to the second toner image.

7. The image forming apparatus according to claim 1, wherein the at least one power source includes:

a direct current power source to output a direct current component; and an alternating current power source to output an alternating current component, and wherein the controller performs the constant voltage control on the direct current component of the transfer bias when the image bias switches to the non-image bias.

8. The image forming apparatus according to claim 1, wherein a third distance is interposed between the adjustment pattern and the first toner image in the rotation direction of the image bearer, wherein a fourth distance is interposed between the adjustment pattern and the second toner image in the rotation direction of the image bearer, and wherein the third distance is greater than the fourth distance.

9. The image forming apparatus according to claim 1, wherein if the adjustment pattern is not between the first toner image and the second toner image on the image bearer, the image bias is equivalent to the non-image bias.

10. The image forming apparatus according to claim 1, wherein when the controller switches the transfer bias from the image bias to the non-image bias that transfers the adjustment pattern, the controller switches the transfer bias through a correction bias that is directed to the non-image bias.

11. The image forming apparatus according to claim 1, wherein the image bearer further includes:

a base layer; and an elastic layer layered on the base layer.

12. The image forming apparatus according to claim 11, wherein the image bearer further includes a plurality of particles dispersed on a surface of the elastic layer.

13. The image forming apparatus according to claim 12, wherein the plurality of particles is charged positively.

14. The image forming apparatus according to claim 12, wherein the plurality of particles is charged negatively.

15. The image forming apparatus according to claim 11, wherein the image bearer further includes a coating layer coating the elastic layer.

16. The image forming apparatus according to claim 11, wherein the image bearer further includes a plurality of resin layers.

17. An image forming apparatus comprising:

an image bearer to bear a toner image and an adjustment pattern;

a transferor to form a transfer nip with the image bearer;

at least one power source to output a transfer bias; and a controller to control the power source to output an image bias as the transfer bias to transfer a first toner image and a second toner image onto a first recording medium and a second recording medium subsequent to the first recording medium, respectively, in the transfer nip, the controller to control the power source to output a non-image bias as the transfer bias to transfer the adjustment pattern onto the transferor in the transfer nip when an interval portion of the image bearer between the first recording medium and the second recording medium passes through the transfer nip during successive printing, the non-image bias being different from the image bias, the controller to perform a constant current control on the image bias and perform a constant voltage control when the image bias switches to the non-image bias.

* * * * *